US007559543B2

(12) United States Patent
Moriyama et al.

(10) Patent No.: US 7,559,543 B2
(45) Date of Patent: Jul. 14, 2009

(54) SHEET PROCESSING APPARATUS AND IMAGE FORMING SYSTEM

(75) Inventors: Tsuyoshi Moriyama, Toride (JP); Hitoshi Kato, Toride (JP); Yasuo Fukatsu, Abiko (JP); Naoki Ishikawa, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/055,026

(22) Filed: Mar. 25, 2008

(65) Prior Publication Data

US 2008/0237965 A1 Oct. 2, 2008

(30) Foreign Application Priority Data

Mar. 27, 2007 (JP) ..... 2007-082360

(51) Int. Cl.
*B65H 37/04* (2006.01)

(52) U.S. Cl. ..... 270/58.12; 270/58.02; 270/58.11; 270/58.17; 270/58.27

(58) Field of Classification Search ..... 270/58.02, 270/58.07, 58.11, 58.12, 58.17, 58.27; 271/249, 271/250, 252
See application file for complete search history.

(56) References Cited

U.S. PATENT DOCUMENTS 5,219,159 A * 6/1993 Malachowski et al. ..... 271/228
5,938,192 A * 8/1999 Kosasa ..... 271/221
7,389,980 B2 * 6/2008 Kushida ..... 270/58.12
7,490,822 B2 * 2/2009 Kushida ..... 270/58.12
2007/0126167 A1 * 6/2007 Kushida ..... 270/58.12
2008/0217845 A1 * 9/2008 Kushida ..... 271/226

FOREIGN PATENT DOCUMENTS

JP 2004-51256 A 2/2004

* cited by examiner

*Primary Examiner*—Gene Crawford
*Assistant Examiner*—Leslie A Nicholson, III
(74) *Attorney, Agent, or Firm*—Rossi, Kimms & McDowell, LLP

(57) ABSTRACT

An image forming system which is capable of preventing paper jam from occurring in a sheet processing apparatus to thereby maintain the stability of the system. An alignment plates of an alignment unit movable in a lateral direction each sheet are brought into abutment with opposite side edges of sheets stacked on the sheet stack unit to laterally align the sheets. A lateral registration sensor unit detects a lateral position of the sheet being conveyed. When the detected lateral position of the sheet is beyond a predetermined position, the CPU of the apparatus changes the standby positions of the alignment plates such that spacing therebetween in the lateral direction the sheet is widened by a predetermined amount, and extends the conveying interval of sheets in the image forming apparatus by a predetermined time period.

7 Claims, 16 Drawing Sheets

FIG. 10

| | LATERAL REGISTRATION SHIFT AMOUNT |
|---|---|
| NORMAL RANGE | 0 ~ ±12.5mm |
| ALARM RANGE | ±12.5mm ~ ±15mm |
| ABNORMAL RANGE | ±15mm ~ |

SHEET PROCESSING APPARATUS AND IMAGE FORMING SYSTEM

BACKGROUND OF THE INVENTION

1. Field of the Invention

The present invention relates to a sheet processing apparatus that is connected to an image forming apparatus that forms images on the sheets and processes sheets discharged from the image forming apparatus, and an image forming system including the sheet processing apparatus and the image forming apparatus.

2. Description of the Related Art

In some cases, a sheet processing apparatus is connected to the sheet discharge side of an image forming apparatus, such as a copying machine, a printer, a facsimile machine, or a multi-function machine including these. Some sheet processing apparatuses of this type are configured to be able to stack and align sheets discharged from the image forming apparatus on a processing tray and then perform binding processing and the like processing on the sheets.

By the way, there has conventionally proposed an image forming apparatus provided e.g. with a correction device (hereinafter referred to as the lateral registration correcting device) configured to detect the side edge of a sheet in the transverse direction orthogonal to a sheet conveying direction and correct the transverse position of the sheet by transversely moving the sheet (see Japanese Paten Laid-Open Publication No. 2004-51256).

According to this proposal, it is possible to correct the transverse position of a sheet to thereby to cause the lateral registration position of the sheet to coincide with an image writing position. Further, since it is possible to detect a side edge of a sheet in the transverse direction and move the sheet during sheet conveyance, sheet position correction can be performed without reducing the productivity of the image forming apparatus. Furthermore, since sheets are subjected to lateral registration correction, each of the sheets can be discharged from the image forming apparatus into a sheet processing apparatus with the position of each side edge thereof in the transverse direction aligned.

In recent years, some systems, typically a high-speed digital copying system, have been configured to have various post-processing apparatuses, such as a casing-in bookbinding apparatus and a large capacity stacker, connected between an image forming apparatus and a sheet processing apparatus.

Therefore, even when a sheet is discharged from the image forming apparatus with the position of the side edge thereof in the transverse direction aligned, a positional shift of the sheet in the transverse direction can occur during conveyance of the sheet in the various post-processing apparatuses.

To cope with this problem, conventionally, sheets are aligned on a processing tray where the sheets are temporarily stacked before being processed, in a sheet processing apparatus. This means that it is required to align sheets on the processing tray even after execution of lateral registration correction in the image forming apparatus.

However, when the amount of a lateral registration shift of a sheet conveyed into the sheet processing apparatus exceeds a tolerable shift amount, the sheet can collide with an alignment plate of the processing tray to be damaged or cause paper jam. A high-speed digital copying system particularly necessitates system stability, and hence it is required to avoid occurrence of paper jam as thoroughly as possible.

SUMMARY OF THE INVENTION

The present invention provides a sheet processing apparatus and an image forming system which are capable of preventing paper jam from occurring in the sheet processing apparatus to thereby maintain the stability of the system.

In a first aspect of the present invention, there is provided a sheet processing apparatus including a sheet stack unit configured to stack sheets from an image forming apparatus, comprising an alignment unit, provided in a manner movable in a lateral direction which is orthogonal to a sheet conveying direction in the sheet processing apparatus, configured to align the sheets in the direction of width of the sheet by being brought into abutment with opposite side edges of the sheet stacked on the sheet stack unit, a position detecting unit configured to detect a sheet position of the lateral direction of the sheet being conveyed by the sheet processing apparatus, and a control unit configured, when the sheet position detected by the position detecting unit is beyond a predetermined position, change a standby position of the alignment unit such that spacing of the alignment unit in the lateral direction is widened by a predetermined amount, and extend a conveying interval of sheets in the image forming apparatus by a predetermined time period.

With the arrangement of the first aspect of the present invention, when the sheet position of the lateral direction of the sheet detected by the position detecting unit is beyond a predetermined position, the standby position of the alignment unit is changed such that spacing of the alignment unit in the lateral direction is widened by a predetermined amount, and the conveying interval of sheets in the image forming apparatus is extended by a predetermined time period. As a consequence, even when the lateral registration position of a sheet conveyed into the sheet processing apparatus is shifted from the proper position by not smaller than the predetermined shift amount, it is possible to avoid collision between the alignment unit of the sheet stack unit and the sheet. This makes it possible to prevent paper jam from occurring in the sheet processing apparatus to thereby ensure the stability of the system.

The sheet processing apparatus comprises a shift unit, provided upstream of the alignment unit in the sheet conveying direction, configured to shift the sheet in the lateral direction of the sheet according to the sheet position detected by the position detecting unit.

The control unit can cause the alignment unit to maintain a standby position in subsequent print jobs following a present job, when the lateral position of the sheet detected by the position detecting unit is beyond the predetermined position, and cause the conveying interval of sheets in the image forming apparatus to be maintained.

The control unit can increase a moving speed of the alignment unit for aligning the sheets, when the sheet position detected by the position detecting unit is beyond the predetermined position.

In a second aspect of the present invention, there is provided a sheet processing apparatus including a sheet stack unit configured to stack sheets from an image forming apparatus, comprising an alignment unit, provided in a manner movable in a lateral direction which is orthogonal to a sheet conveying direction in the sheet processing apparatus, configured to align the sheets in the lateral direction by being brought into contact with opposite side edges of the sheet stacked on the sheet stack unit, a position detecting unit configured to detect a sheet position of the lateral direction of the sheet being conveyed in the sheet processing apparatus, a shift conveying unit, provided upstream of the alignment unit in the sheet conveying direction, configured to shift the sheet in the lateral direction, and a control unit configured, when the sheet position detected by the position detecting unit is beyond a predetermined position, change a standby position of the alignment unit such that spacing of the alignment unit in the lateral direction is widened by a predetermined amount, and increase a moving speed of the alignment unit during an operation for aligning the sheets.

With the arrangement of the second aspect of the present invention, when the lateral registration position of a sheet conveyed into the sheet processing apparatus is shifted from the proper position by not smaller than the predetermined shift amount, the standby position of the alignment unit is changed such that spacing of the alignment unit in the lateral direction of the sheet is widened by a predetermined amount, and the moving speed of the alignment unit is increased during an operation for aligning the sheets. As a consequence, even when the lateral registration position of a sheet conveyed into the sheet processing apparatus is shifted from the proper position by not smaller than the predetermined shift amount, it is possible to avoid collision between the alignment unit of the sheet stack unit and the sheet. Thus, it is possible to prevent paper jam from occurring in the sheet processing apparatus to thereby ensure the stability of the system.

In a third aspect of the present invention, there is provided an image forming system comprising an image forming apparatus that performs image formation on sheets, and a sheet processing apparatus connected to the image forming apparatus, the sheet processing apparatus including a sheet stack unit configured to stack sheets from an image forming apparatus, comprising an alignment unit, provided in a manner movable in a lateral direction which is orthogonal to a sheet conveying direction in the sheet processing apparatus, configured to align the sheets in the lateral direction by being brought into abutment with opposite side edges of the lateral direction of the sheet stacked on the sheet stack unit, a position detecting unit configured to detect a sheet position of the lateral position of the sheet being conveyed in the sheet processing apparatus, and a control unit configured to, when the sheet position detected by the position detecting unit is beyond a predetermined position, change a standby position of the alignment unit such that spacing of the alignment unit in the lateral direction is widened by a predetermined amount, and extend a conveying interval of sheets in the image forming apparatus by a predetermined time period.

In a fourth aspect of the present invention, there is an image forming system comprising an image forming apparatus that performs image formation on sheets, and a sheet processing apparatus connected to the image forming apparatus, the sheet processing apparatus including a sheet stack unit configured to stack sheets from an image forming apparatus, comprising an alignment unit, provided in a manner movable in a lateral direction which is orthogonal to a sheet conveying direction in the sheet processing apparatus, configured to align the sheets in the lateral direction by being brought into abutment with opposite side edges of the sheet stacked on the sheet stack unit, a position detecting unit configured to detect a sheet position of the lateral direction of the sheet being conveyed in the sheet processing apparatus, a shift conveying unit provided upstream of the alignment unit in the sheet conveying direction, for shifting the sheet in the lateral direction, and a control unit configured, when the sheet position detected by the position detecting unit is beyond a predetermined position, change a standby position of the alignment unit such that spacing of the alignment unit in the lateral direction is widened by a predetermined amount, and increase a moving speed of the alignment unit during an operation for aligning the sheets.

The features and advantages of the invention will become more apparent from the following detailed description taken in conjunction with the accompanying drawings.

BRIEF DESCRIPTION OF THE DRAWINGS

FIG. 10 is a diagram useful in explaining ranges of a lateral registration shift amount.

DETAILED DESCRIPTION OF THE EMBODIMENTS

The present invention will now be described in detail with reference to the drawings showing preferred embodiments thereof.

Figure 1:
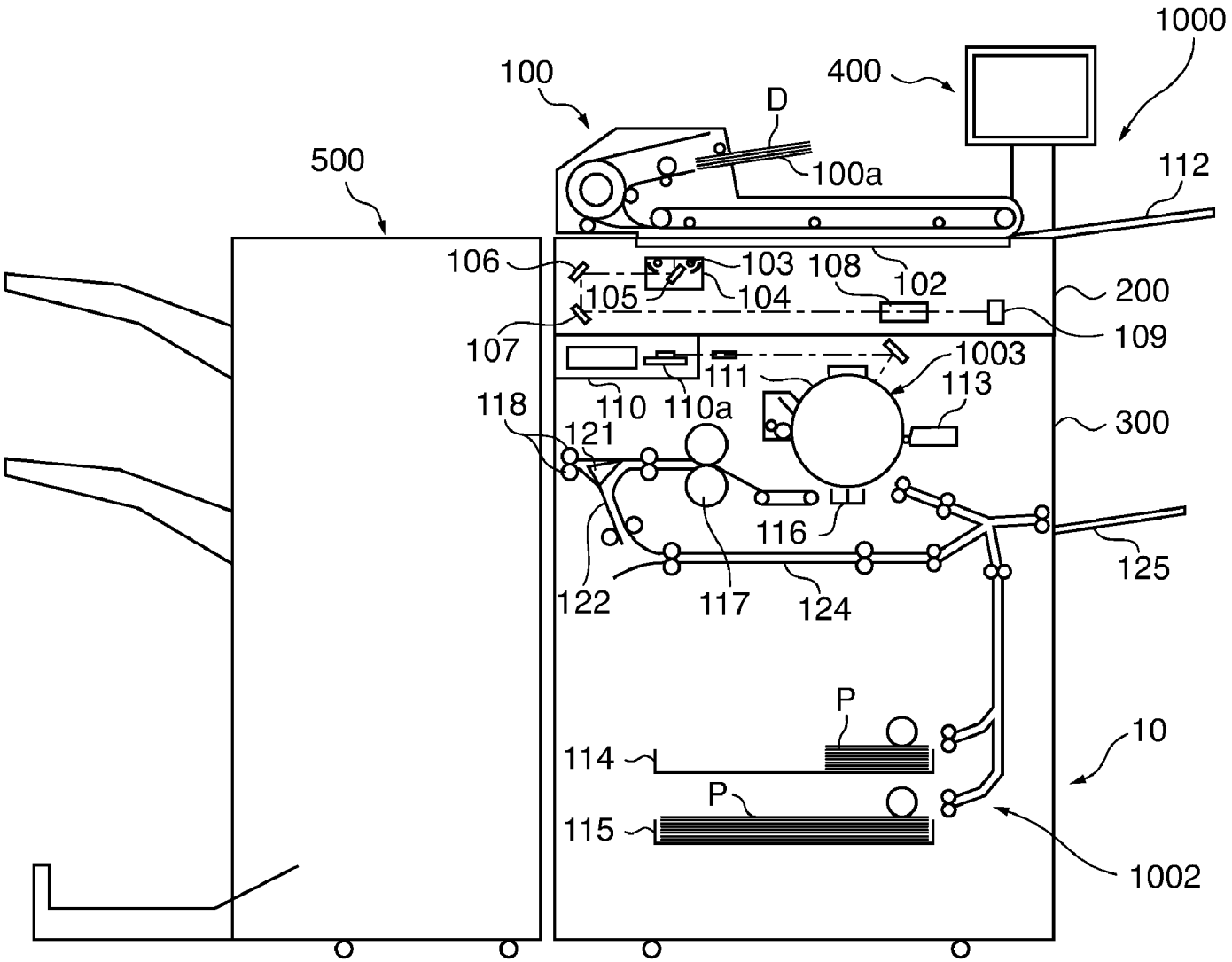
FIG. 1 is a schematic cross-sectional view of an image forming system according to a first embodiment of the present invention.

FIG. 1 is a schematic cross-sectional view of an image forming system according to a first embodiment of the present invention. As shown in FIG. 1, the image forming system 1000 is comprised of a copying machine (image forming apparatus) 10, and a finisher (sheet processing apparatus) 500 connected to the sheet discharge side of the copying machine 10.

A scanner 200 for reading originals is disposed in the upper part of the copying machine 10. The scanner 200 includes an original feeder 100, a scanner unit 104, mirrors 105 to 107, and an image sensor 109. In the case of reading originals D by the scanner 200, first, the user sets (stacks) the originals D on a tray 100*a* of the original feeder 100. It is assumed that each of the originals D is set on the tray 100*a*, face-up, i.e. with an image-forming surface thereof facing upward.

Next, the originals D set on the tray 100*a* are sequentially conveyed one by one from the leading page in a leftward direction as viewed in FIG. 1. Then, each original D is conveyed onto a platen glass 102 via a curved path to be conveyed on the platen glass 102 in a rightward direction as viewed in FIG. 1, whereafter the original D is discharged onto a discharge tray 112.

In the case of performing original reading in this so-called moving original reading mode, the scanner unit 104 is held in a predetermined position, and an original D passes the scanner unit 104 from left to right, whereby the original D is read. More specifically, scanning is performed to read the original D with a transverse direction orthogonal to the conveying direction of the original as the main scanning direction and the conveying direction of the original as the sub scanning direction.

In this reading operation, the original D passing the scanner unit 104 is irradiated with light from a lamp 103 of the scanner unit 104, and reflected light from the original D is guided to an image sensor 109 via the mirrors 105 to 107 and a lens 108. It should be noted that image data read line by line from the original D by the image sensor 109 is subjected to predetermined image processing by an image signal control section 202, described hereinafter with reference to FIG. 3, and then is sent to an exposure control section 110.

On the other hand, in the case of performing original reading in the so-called stationary original reading mode, an original D having been conveyed by the original feeder 100 is temporarily stopped on the platen glass 102, and in this state, the scanner unit 104 is moved from left to right, whereby the original D is read. Further, in the case of performing original reading without using the original feeder 100, the user lifts the original feeder 100 and sets an original D on the platen glass 102, whereafter original reading is performed in the stationary original reading mode.

The copying machine 10 includes a sheet feeding section 1002 for feeding sheets P contained in a cassette 114 or 115 and an image forming section 1003 for forming an image on a sheet P fed by the sheet feeding section 1002.

The image forming section 1003 includes a photosensitive drum 111, a developing device 113, and a transfer charger 116. In the case of forming an image, a laser beam from the exposure control section 110 is irradiated onto the photosensitive drum 111, whereby a latent image is formed on the photosensitive drum 111. Then, the latent image is visualized as a toner image by the developing device 113. It should be noted that at respective locations downstream of the image forming section 1003, there are arranged a fixing device 117, a discharge roller pair 118, and so forth.

An operating and display unit 400 is disposed on the copying machine 10. The operating and display unit 400 includes a plurality of keys for use in configuring various functions for an image forming operation, and a display section for displaying information indicative of settings.

Next, a description will be given of the image forming operation performed by the copying machine 10.

Figure 3:
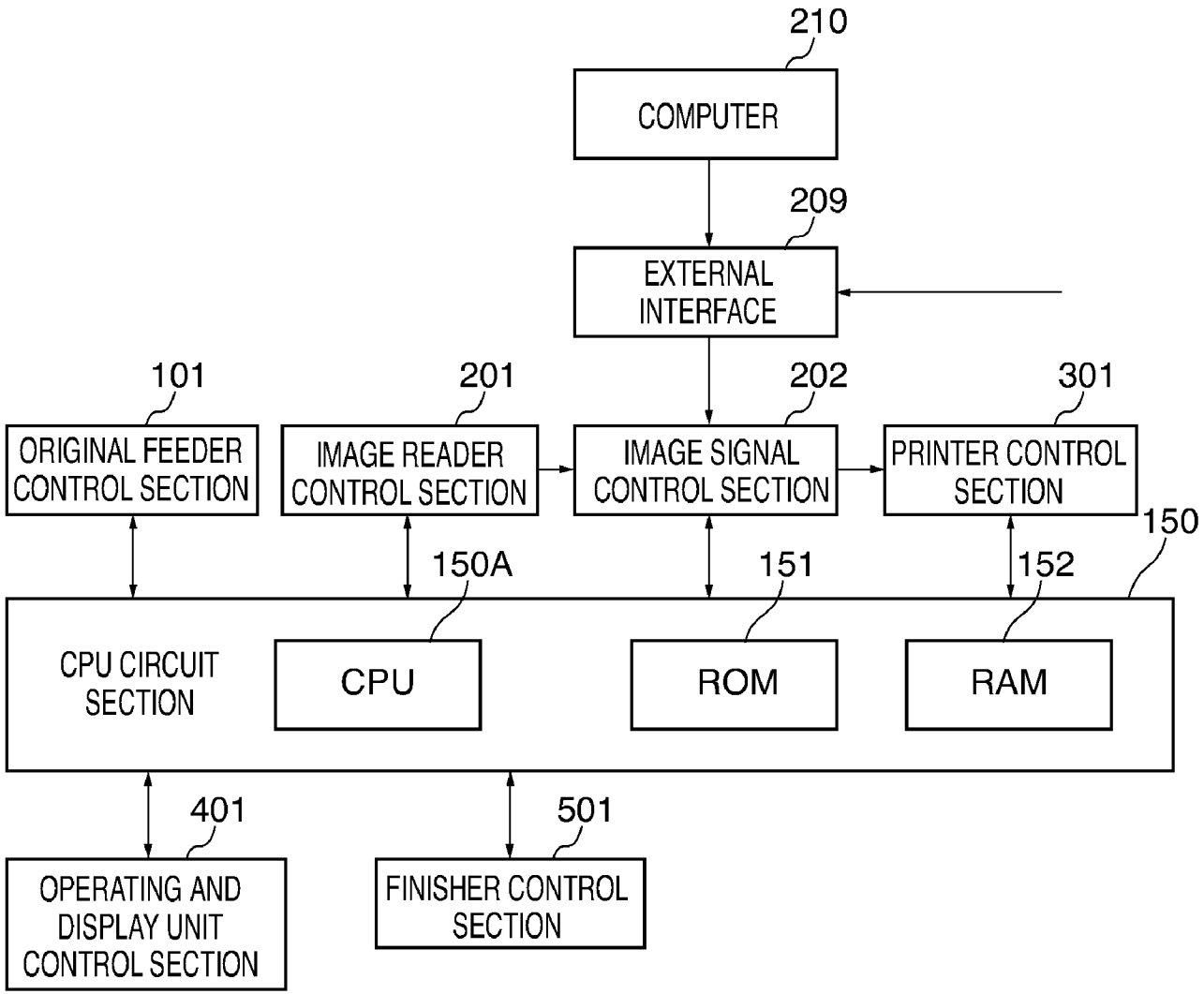
FIG. 3 is a control block diagram of the image forming system.

First, image data read from an original D by the image sensor 109 in the moving original reading mode or the stationary original reading mode executed by the scanner 200 is subjected to the predetermined image processing by the image signal control section 202 appearing in FIG. 3, and then delivered to the exposure control section 110. Thereafter, the exposure control section 110 outputs a laser beam corresponding to the image signal.

The laser beam is irradiated onto the photosensitive drum 111 while being scanned by a polygon mirror 110*a*, whereby an electrostatic latent image is formed on the photosensitive drum 111 according to the scanned laser beam. Then, the electrostatic latent image formed on the photosensitive drum 111 is visualized as a toner image by the developing device 113.

On the other hand, a sheet P is conveyed from one of the cassettes 114 and 115, a manual sheet feeder 125, and a double-sided conveying path 124 to a transfer section comprised of the photosensitive drum 111 and the transfer charger 116. The visualized toner image on the photosensitive drum 111 is transferred onto the sheet P in the transfer section, and the sheet P having the image transferred thereon is subjected to fixing processing by the fixing device 117. Then, the sheet P having undergone the fixing processing is discharged into the finisher 500 from the discharge roller pair 118.

When the sheet P is to be discharged face-down, i.e. with a surface with a toner image thereon facing downward, the sheet P having passed through the fixing device 117 is temporarily guided into a path 122 by a flapper 121. Then, after the trailing end of the sheet P has passed through the flapper 121, the sheet P is switched back and conveyed to the discharge roller pair 118 by the flapper 121, followed by being discharged from the copying machine 10.

Thus, the sheet P is discharged from the copying machine 10, with the surface with the toner image thereon facing downward. By discharging sheets P by the so-called inverted discharge, it is possible to stack the sheets P in the correct page order in a case where images are sequentially formed starting with the leading page, e.g. when images read using the original feeder 100 are formed or when images output from a computer are formed.

When an image forming process is performed on a harder sheet P, such as an OHP sheet conveyed from the manual sheet feeder 125, the sheet P is not guided into the path 122, and hence discharged from the copying machine 10 by the discharge roller pair 118, face-up, i.e. with a surface with a toner image thereon facing upward.

Further, when images are formed on both sides of a sheet P, respectively, the sheet P is guided from the fixing device 117 toward the discharge roller pair 118, and immediately after the trailing end of the sheet P has passed through the flapper 121, the sheet P is switched back and guided by the flapper 121 from the path 122 to a double-sided conveying path 124.

The sheet P thus discharged from the copying machine 10 is taken into the finisher 500 for performing binding processing or bookbinding processing on sheets having images formed thereon.

Figure 2:
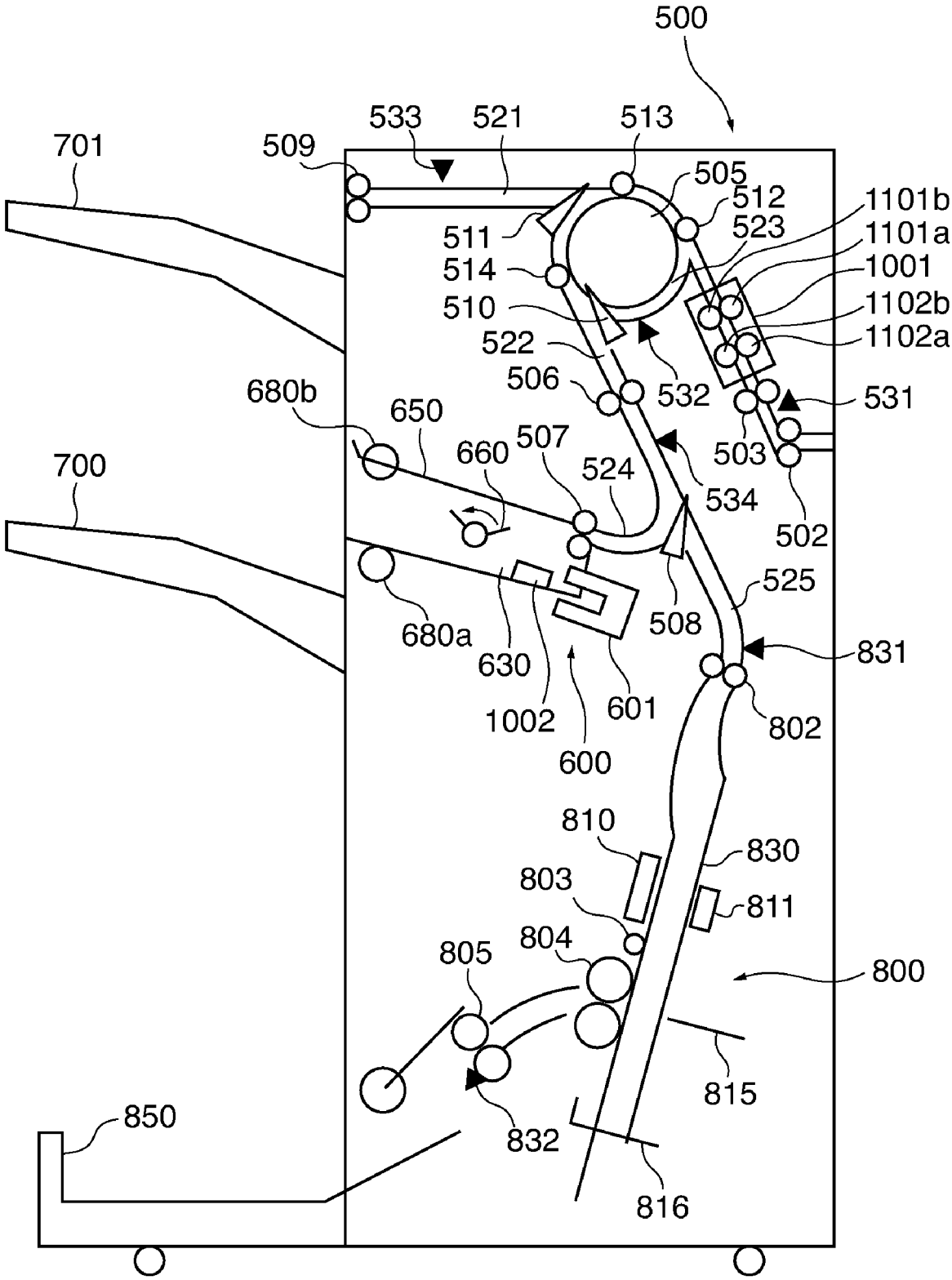
FIG. 2 is a schematic cross-sectional view of a finisher.

Next, a description will be given of the finisher 500 with reference to FIG. 2.

The finisher 500 sequentially receives sheets discharged from the copying machine 10, and performs a process for aligning the received sheets into a bundle, and a sorting process for sorting sheets on a bundle-by-bundle basis or a non-sorting process, as well as a stapling process (binding process) for stapling the trailing end of a sheet bundle by a stapler, a bookbinding process, and so forth. The finisher 500 is comprised of a stapler section 600 for stapling sheets, and a bookbinding section 800 as a section that performs the bookbinding process for folding a sheet bundle in two and binding the same.

The stapler section 600 is comprised of a processing tray 630 as a sheet stacker unit on which a plurality of sheets are temporarily stacked, and alignment plates 1002 as a pair of alignment units for aligning the sheet bundle stacked on the processing tray 630 transversely i.e. in a lateral direction which is orthogonal to the sheet conveying direction. The stapler section 600 is further comprised of a stapler 601 for stapling the sheet bundle.

The bookbinding section 800 is comprised of a bookbinding inlet sensor 831, a pair of staplers 810, and a bookbinding tray 830 on which sheets are stacked. The bookbinding tray 830 is provided with an intermediate roller 803 and a movable sheet positioning member 816.

An anvil 811 is provided at a location opposed to the pair of staplers 810, and the staplers 810 and the anvil 811 cooperate to perform stapling processing on the bundle of sheets received in the bookbinding tray 830.

A fold roller pair 804 is disposed at a location downstream of the staplers 810, and a thrusting member 815 is disposed at a location opposed to the fold roller pair 804. The thrusting member 815 is caused to project toward the sheet bundle received in the bookbinding tray 830, whereby the sheet bundle is pushed in between the fold roller pair 804. A sheet discharge sensor 832 is disposed at a location downstream of the conveying roller pair 805.

The finisher 500 is provided with an inlet roller pair 502 for taking in a sheet discharged from the copying machine 10, and a conveying roller pair 503 for conveying the taken-in sheet, and an inlet sensor 531 is disposed between the inlet roller pair 502 and the conveying roller pair 503.

Further, between the conveying roller pair 503 and a buffer roller 505, there is disposed a lateral registration-detecting device 1001 as a shifting conveying unit for conveying a sheet while shifting the same to a predetermined position in the transverse direction, i.e. in the lateral direction, in a shift sorting mode for transversely offsetting a sheet and discharging the same. It should be noted that the lateral registration-detecting device 1001 also functions as a sheet position detector unit for detecting the side end positions of a sheet in the transverse direction, as described hereinafter.

In the shift sorting mode, the lateral registration-detecting device 1001 operates for all sheets conveyed into the finisher 500, to correct the lateral registration of each sheet and convey the sheet while shifting the same to the predetermined position in the transverse direction. The lateral registration-detecting device 1001 is comprised of conveying rollers 1101*a* and 1102*a* and driven rollers 1101*b* and 1102*b* in pressure contact with the respective conveying rollers 1101*a* and 1102*a*.

At a location downstream of the lateral registration-detecting device 1001, there is disposed the buffer roller 505 which is capable of winding a predetermined number of sheets conveyed thereto via the conveying roller pair 503 and the lateral registration-detecting device 1001, around the outer periphery thereof. The sheets are wound around the outer periphery of the buffer roller 505 by pressing rollers 512, 513, and 514 during rotation of the buffer roller 505, and conveyed in the direction of rotation of the buffer roller 505.

A switching flapper 511 is disposed between the pressing rollers 513 and 514, and a switching flapper 510 is disposed at a location downstream of the pressing roller 514. The switching flapper 511 operates selectively to guide the sheets wound around the buffer roller 505 to a sorting path 522 in the state wound around the buffer roller 505, or to peel off the sheets from the buffer roller 505 to guide the same into a non-sorting path 521 extending toward a sample tray 701. It should be noted that reference numeral 533 in FIG. 2 designates a sheet discharge sensor disposed in an intermediate portion of the non-sorting path 521.

On the other hand, the switching flapper 510 operates selectively to peel off the sheets wound around the buffer roller 505 to guide the same into the sorting path 522, or to simply guide the same into a buffer path 523, in the state wound around the buffer roller 505. In the buffer path 523, there is disposed a buffer path sensor 532 for detecting a sheet on the buffer path 523.

At a downstream location of the sorting path 522, there is disposed a switching flapper 508. The switching flapper 508 guides sheets guided into the sorting path 522 into a sorting discharge path 524 or a bookbinding path 525.

The sheets guided into the sorting discharge path 524 are stacked on the processing tray 630 via a conveying roller pair 507. A paddle 660 pivotally moves into contact with a top sheet of the sheet bundle stacked on the processing tray 630 and operates to bring the same into abutment with the right side end of the processing tray 630. The sheets stacked on the processing tray 630 are subjected to alignment processing and stapling processing, as required, followed by being discharged onto a stack tray 700 by discharge rollers 680*a* and 680*b*.

The discharge roller 680*b* is supported by a swinging guide 650. The swinging guide 650 is swung by a swinging motor, not shown, to bring the discharge roller 680*b* into contact with the top sheet of a sheet bundle on the processing tray 630. When in contact with the top sheet on the processing tray 630, the discharge roller 680*b* is capable of cooperating with the discharge roller 680*a* to discharge the sheet bundle from the processing tray 630 toward the stack tray 700.

When a sheet is discharged from the copying machine 10 into the finisher 500 constructed as above, first, the sheet is received by the inlet roller pair 502. At this time, sheet passing timing is simultaneously detected by the inlet sensor 531.

Next, the sheet conveyed via the inlet roller pair 502 is further conveyed while having the lateral registration shift amount detected by the lateral registration-detecting device 1001. Then, the sheet is conveyed to the buffer roller 505 and is wound around the outer periphery of the buffer roller 505 by the pressing rollers 512, 513, and 514 during rotation of the buffer roller 505 to be conveyed in the direction of rotation of the buffer roller 505. The lateral registration shift amount-detecting operation by the lateral registration-detecting device 1001 will be described hereinafter.

When the non-sorting processing is to be performed, a sheet is peeled off from the buffer roller 505 by the switching flapper 511 and is guided into the non-sorting path 521 to be discharged onto the sample tray 701 via the discharge roller pair 509.

On the other hand, in a case where the sorting processing, the binding processing, or the bookbinding processing is performed, to convey a bundle of a predetermined number of sheets e.g. to the stapler section 600, sheets are sequentially conveyed into the buffer path 523 by the switching flappers 511 and 510 each in a state wound around the buffer roller 505.

Then, when the predetermined number of sheets have been conveyed into the buffer path 523, the sheets are peeled off from the buffer roller 505 by the switching flapper 510 to be conveyed into the sorting path 522. The sheets conveyed into the sorting path 522 pass through a conveying roller pair 506 to be guided into the sorting discharge path 524 or the bookbinding path 525 by the switching flapper 508.

The sheets guided into the sorting discharge path 524 by the switching flapper 508 are stacked on the processing tray 630. Then, the sheets stacked on the processing tray 630 as a bundle are subjected to the aligning processing by the pair of alignment plates 1002 and the stapling processing by the stapler 601, according to settings configured via the operating and display unit 400 appearing in FIG. 1. Each of the sheet bundles having undergone the aligning processing by the alignment plates 1002 and the stapling processing by the stapler 601 is discharged onto the stack tray 700 by the discharge rollers 680*a* and 680*b*. When in the shift sorting mode as well, sheets are aligned by the alignment plates 1002 on a sheet bundle-by-sheet bundle basis, followed by being discharged onto the stack tray 700 by the discharge rollers 680*a* and 680*b*.

The stapler 601, which performs the stapling processing, is configured to be movable along the outer periphery of the processing tray 630. This makes it possible to bind the trailing end (rear end) of a sheet bundle stacked on the processing tray 630 with respect to the sheet conveying direction (leftward direction as viewed in FIG. 2).

On the other hand, sheets guided into the bookbinding path 525 by the switching flapper 508 are conveyed onto the bookbinding tray 830 via a conveying roller pair 802, and the sheets stacked as a bundle are subjected to stapling processing by the staplers 810 and the anvil 811. Thereafter, the sheet bundle is pushed in between the fold roller pair 804 by the thrust member 815 to be folded in two and is conveyed downstream by the fold roller pair 804. Then, the folded sheet bundle is discharged onto a discharge tray 850 via a conveying roller pair 805.

Next, a control system of the copying machine 10 will be described with reference to FIG. 3.

The copying machine 10 includes a CPU circuit section 150. The CPU circuit section 150 incorporates a CPU 150A, a ROM 151, and a RAM 152, and performs centralized control of sections 101, 201, 202, 209, 301, 401, and 501, based on control programs stored in the ROM 151. The RAM 152 temporarily stores control data, and is also used as a work area for carrying out arithmetic operations involved in control processing.

The original feeder control section 101 drivingly controls the original feeder 100 according to instructions from the CPU circuit section 150. The image reader control section 201 drivingly controls the scanner unit 104 of the scanner 200, the image sensor 109, and so forth, and transfers an analog image signal output from the image sensor 109 to the image signal control section 202.

The image signal control section 202 converts the analog image signal input from the image sensor 109 via the image reader control section 201 into a digital signal, then performs various kinds of processing on the digital signal, and converts the processed digital signal into a video signal, followed by delivering the video signal to the printer control section 301. Further, the image signal control section 202 performs various kinds of processing on a digital image signal input from an external computer 210 via the external interface 209, and converts the processed digital image signal into a video signal, followed by delivering the video signal to the printer control section 301. The processing operations executed by the image signal control section 202 are controlled by the CPU circuit section 150.

The printer control section 301 drives the exposure control section 110 based on the received video signal input from the image signal control section 202. The operating and display unit control section 401 exchanges information with the operating and display unit 400 and the CPU circuit section 150. Further, the operating and display unit control section 401 outputs a key signal delivered from the operating and display unit 400 in accordance with operation of each key, to the CPU circuit section 150, and displays corresponding information on the display section of the operating and display unit 400, based on a signal from the CPU circuit section 150.

The finisher control section 501 is incorporated e.g. in the finisher 500, and exchanges information with the CPU circuit section 150 to thereby control the overall operation of the finisher 500. It should be noted that the finisher control section 501 may be provided in the copying machine 10.

Figure 4:
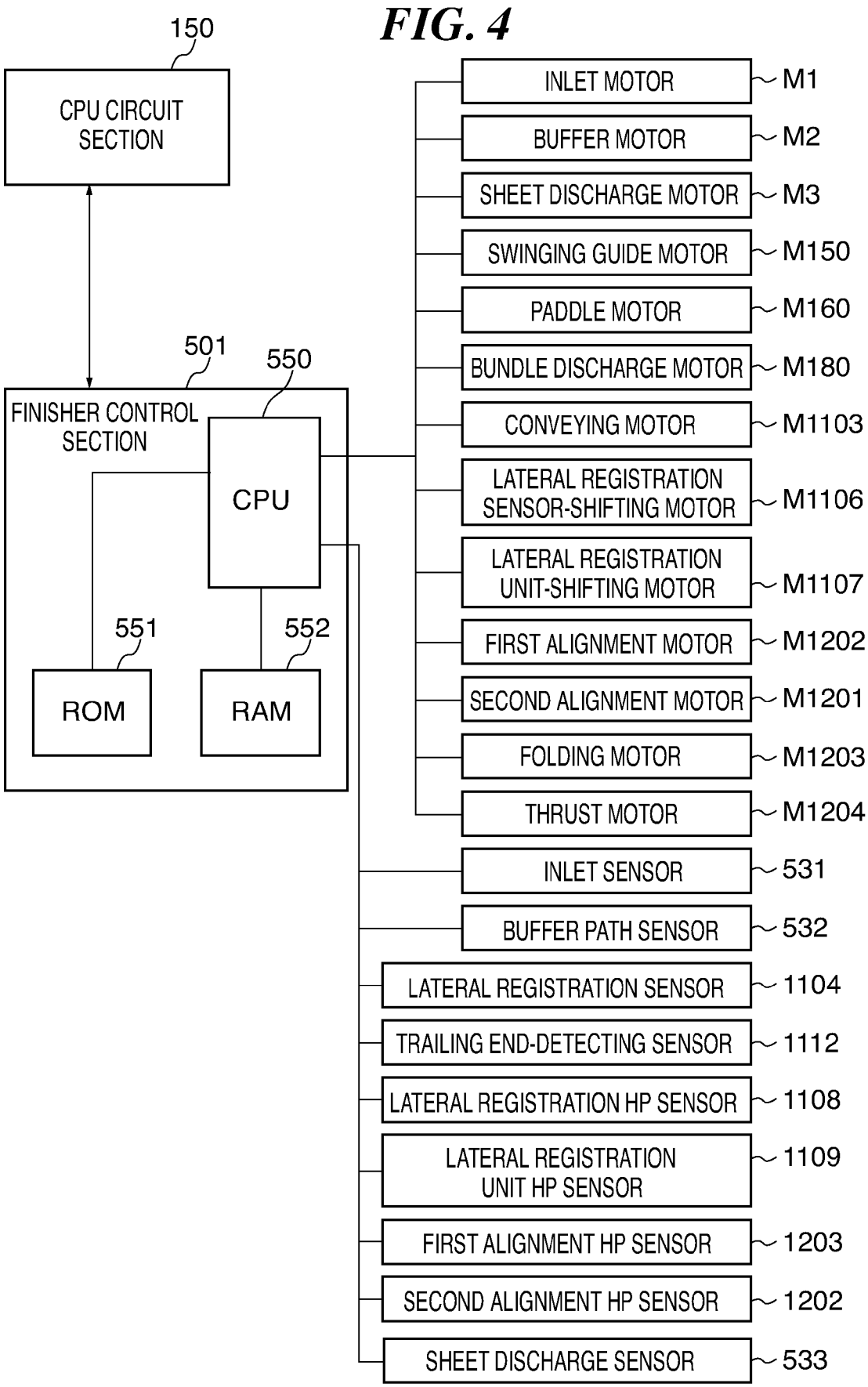
FIG. 4 is a control block diagram of a finisher controller.

Next, the finisher control section 501 will be described with reference to FIG. 4.

The finisher control section 501 is comprised of a CPU 550, a ROM 551, and a RAM 552. The finisher control section 501 communicates with the CPU circuit section 150 provided in the copying machine 10 via a communication IC, not shown, for data exchange, and executes various programs stored in the ROM 552 to control the driving of the finisher 500 according to instructions from the CPU circuit section 150. Further, the finisher control section 501 controls the driving of each of motors based on a signal from an associated one of the sensors 531 to 533 and sensors 1104, 1112, 1108, 1109, 1203, and 1202. More specifically, the finisher control section 501 controls the driving of each of the motors M1 to M3, M150, M160, M180, M1103, M1106, M1107, M1202, M1201, M1203, M1204, and so forth based on the associated signal.

Next, the lateral registration-detecting device 1001 of the finisher 500 will be described with reference to FIG. 5.

The lateral registration-detecting device 1001 includes the conveying motor M1103. The lateral registration-detecting device 1001 drives the conveying motor M1103 to give a driving force to the conveying rollers 1101*a* and 1102*a* via a gear 1116 and a timing belt 1115, whereby the conveying rollers 1101*a* and 1102*a* cooperate with the driven rollers 1101*b* and 1102*b* to convey a sheet.

The leading end of a sheet being conveyed is detected by the lateral registration sensor 1104. The lateral registration sensor 1104 is mounted in a lateral registration sensor unit 1105 that is driven by the lateral registration sensor-shifting motor M1106 to move in the transverse directions indicated by arrows 44 and 43. The home position of the lateral registration sensor unit 1105 is detected by the lateral registration HP sensor 1108.

Figure 5:
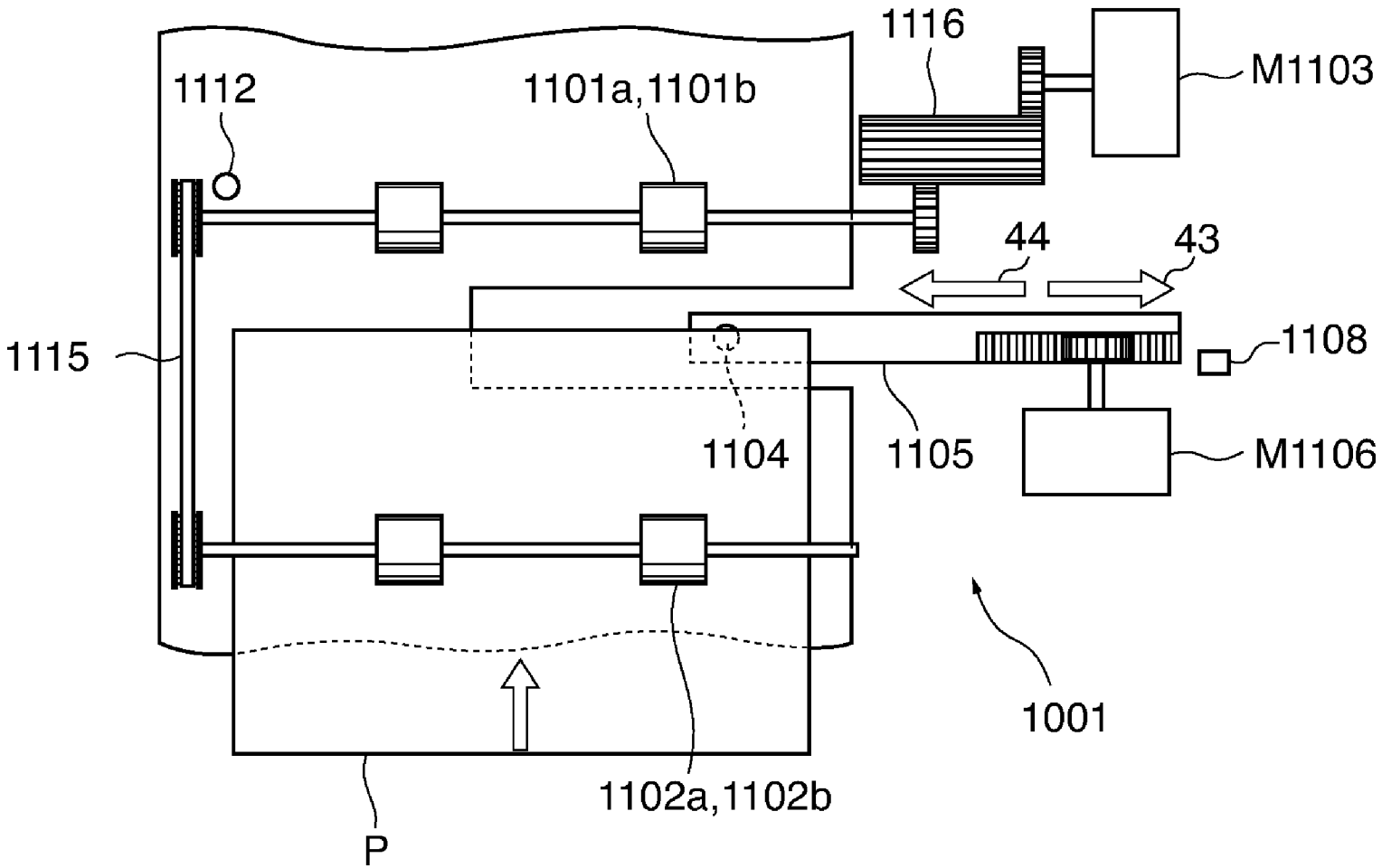
FIG. 5 is a schematic view useful in explaining a lateral registration-detecting device provided in the finisher.

In FIG. 5, reference numeral 1112 designates a trailing end-detecting sensor, and the trailing end-detecting sensor 1112 detects a sheet being conveyed. Further, the trailing end-detecting sensor 1112 detects that the trailing end of the sheet has passed through the conveying rollers 1101*a* and 1101*b* within the lateral registration-detecting device 1001.

Figure 6:
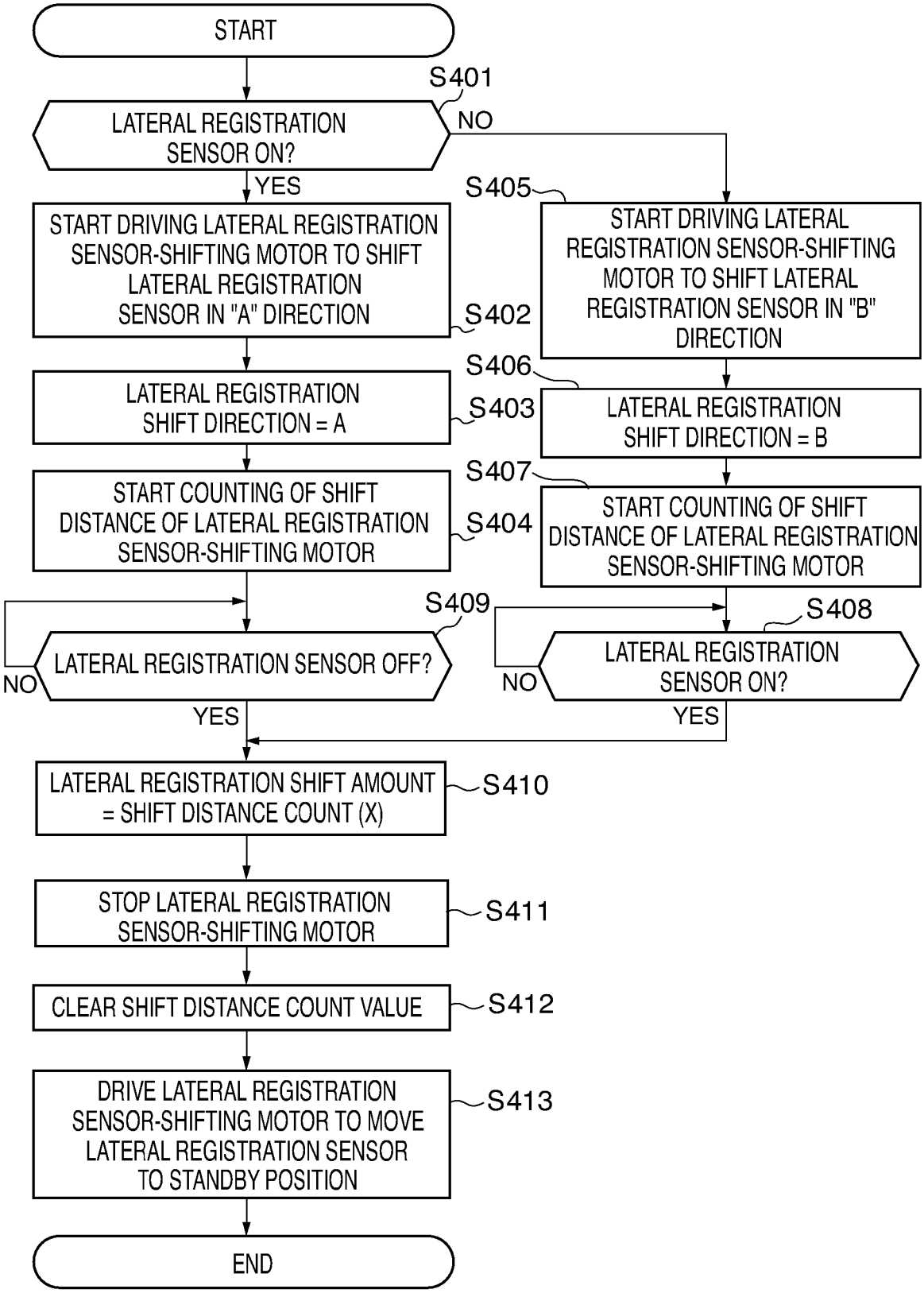
FIG. 6 is a flowchart of a lateral registration detecting process.

Next, a lateral registration detecting process executed by the lateral registration-detecting device 1001 will be described with reference to FIG. 6.

First, in a step S401, the CPU 550 of the finisher control section 501 determines whether or not the lateral registration sensor 1104 is on. If the lateral registration sensor 1104 is on, the process proceeds to a step S402.

In the step S402, the CPU 550 drives the lateral registration sensor-shifting motor M1106 to shift the lateral registration sensor 1104 in an A direction. The A direction is a direction indicated by the arrow 43 in FIG. 5, in which the lateral registration sensor 1104 eventually becomes incapable of detecting the sheet.

Next, in a step S403, the CPU 550 stores the direction of a lateral registration shift that is being measured, as the A direction, in the RAM 403. Further, the CPU 550 starts counting of a shift distance of the lateral registration sensor 1104 in a step S404, and then the process proceeds to a step S409.

In the step S409, the CPU 550 determines whether or not the lateral registration sensor 1104 has been turned off. If the lateral registration sensor 1104 has not been turned off, the step S409 is repeatedly carried out. On the other hand, if the CPU 550 determines in the step S409 that the lateral registration sensor 1104 has been turned off, the process proceeds to a step S410.

If the CPU 550 determines in the step S401 that the lateral registration sensor 1104 is off, the process proceeds to a step S405, wherein the CPU 550 drives the lateral registration sensor-shifting motor M1106 to shift the lateral registration sensor 1104 in a B direction. The B direction is a direction indicated by the arrow 44 in FIG. 5, in which the lateral registration sensor 1104 eventually becomes capable of detecting the sheet.

Next, in a step S406, the CPU 550 stores the direction of a lateral registration shift that is being measured, as the B direction, in the RAM 403. Further, the CPU 550 starts counting of the shift distance of the lateral registration sensor 1104 in a step S407. The counting of the shift distance is performed by counting the driving amount of the lateral registration sensor-shifting motor M1106. For example, when the lateral registration sensor-shifting motor M1106 is implemented by a pulse motor, drive pulses are counted, whereas when the lateral registration sensor-shifting motor M1106 is implemented by a DC motor, FG signal pulses from the motor or pulses transmitted from an encoder provided at the motor are counted. Then, in a step S408, the CPU 550 determines whether or not the lateral registration sensor 1104 has been turned off. If the lateral registration sensor 1104 has not been turned off, the step S408 is repeatedly carried out. On the other hand, if the CPU 550 determines in the step S408 that the lateral registration sensor 1104 has been turned off, the process proceeds to the step S410.

Then, in the step S410, the CPU 550 stores a shift distance count value X indicative of a shift distance over which the lateral registration sensor 1104 is moved before it is turned on or off, as a lateral registration shift amount in the RAM 403.

Next, the CPU 550 stops the lateral registration sensor-shifting motor M1106 in a step S411, and clears the shift distance count value X in a step S412. Then, in a step S413, the CPU 550 drives the lateral registration sensor-shifting motor M1106 to shift the lateral registration sensor 1104 to a standby position.

When a sheet is conveyed into the finisher 500, the side end position thereof, i.e. a transverse shift amount with respect to a reference position is detected by the lateral registration sensor 1104 of the lateral registration-detecting device 1001, whereafter the sheet is conveyed to the processing tray 630 to be subjected to alignment processing on the processing tray 630.

Next, the processing tray 630 will be described with reference to FIG. 7.

Figure 7:
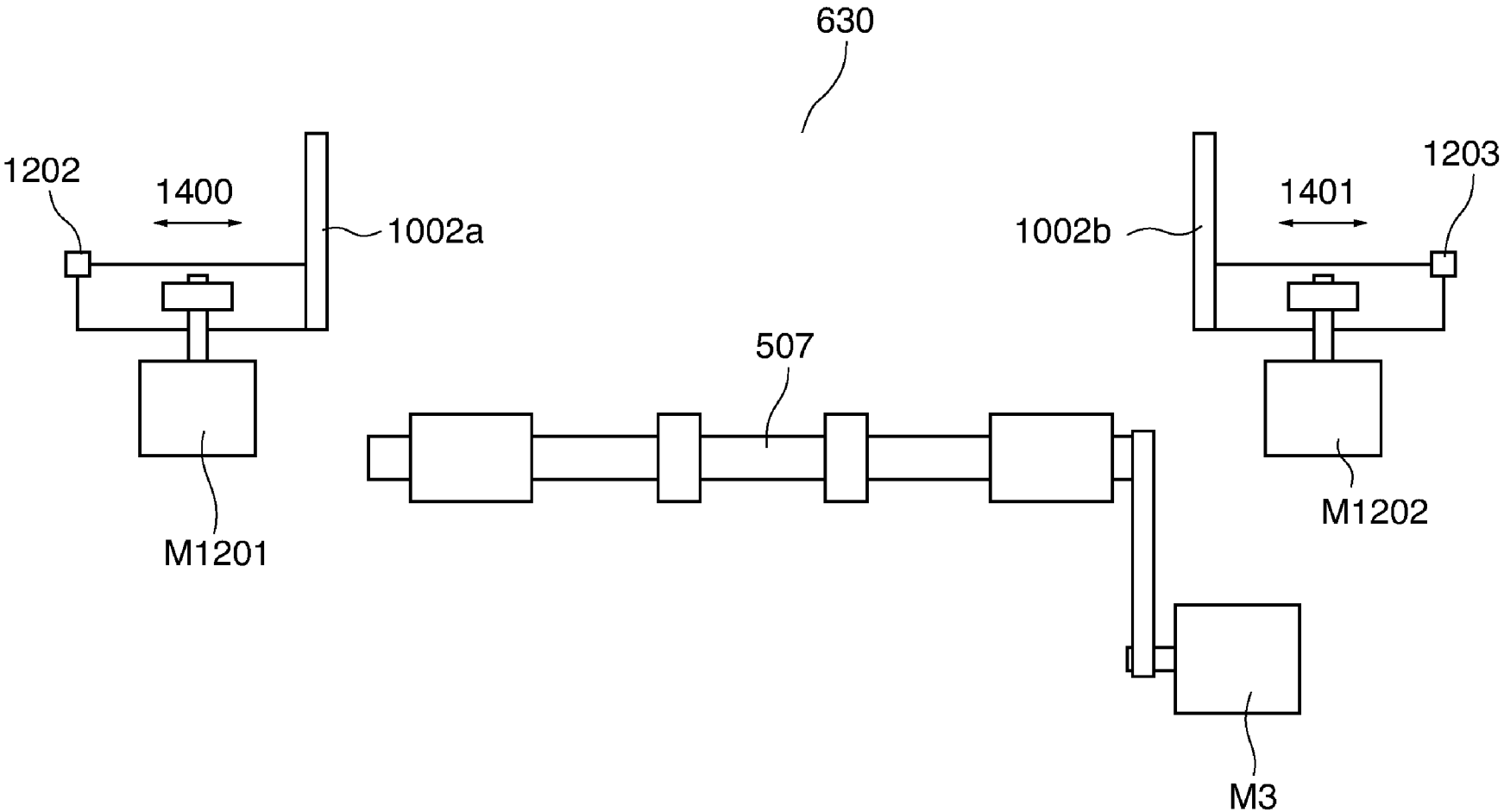
FIG. 7 is a view useful in explaining a processing tray provided in the finisher.

In FIG. 7, reference numeral M3 designates the sheet discharge motor. Sheets are discharged onto the processing tray 630 by the conveying roller pair 507 driven by the sheet discharge motor M3. In FIG. 7, reference numeral M1201 designates the first alignment motor, and M1202 the second alignment motor. The first alignment motor M1201 and the second alignment motor M1202 drive the respective first and second alignment plates 1002*a* and 1002*b* for aligning a sheet discharged onto the processing tray 630. It should be noted that the first alignment plate and the second alignment plate are disposed at the respective "front" and "rear" sides of the finisher 500, as viewed in FIG. 2.

The first alignment plate 1002*a* and the second alignment plate 1002*b* constitutes the pair of alignment units and are driven separately in respective directions indicated by arrows 1401 and 1400 so as to be brought into abutment with the respective side edges of the sheet in the transverse direction, whereby the sheet is aligned. Reference numerals 1202 and 1203 in FIG. 7 designate a first alignment HP sensor and a second alignment HP sensor for detecting the home position of the first alignment plate 1002*a* and that of the second alignment plate 1002*b*, respectively.

Figure 8A:
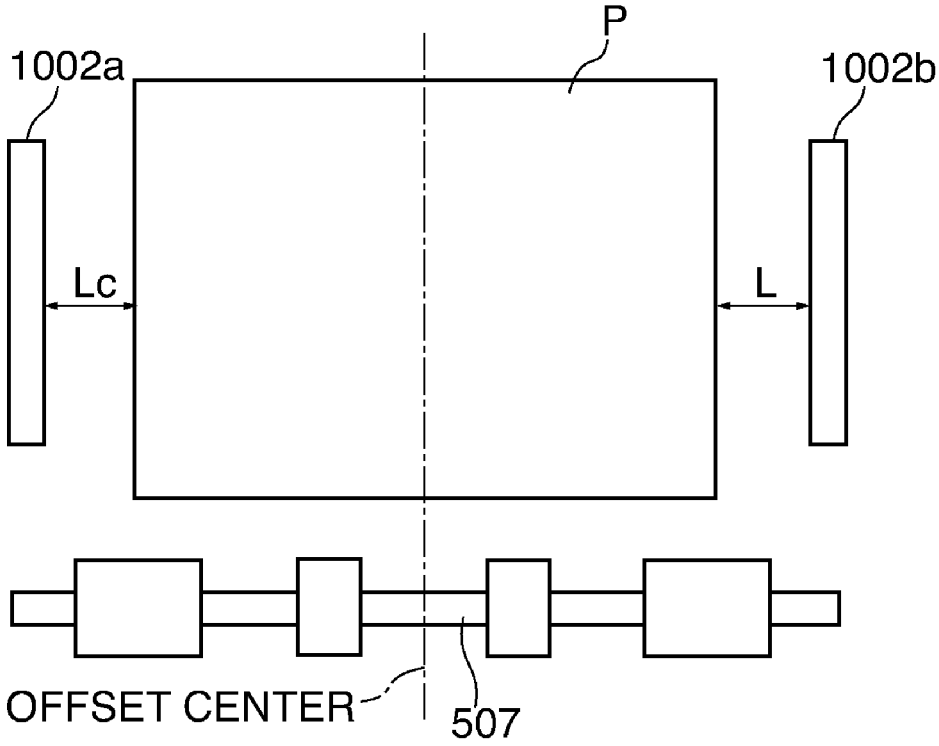
FIGS. 8A and 8B are views useful in explaining respective standby positions of alignment plates of the processing tray provided in the finisher.
Figure 8B:
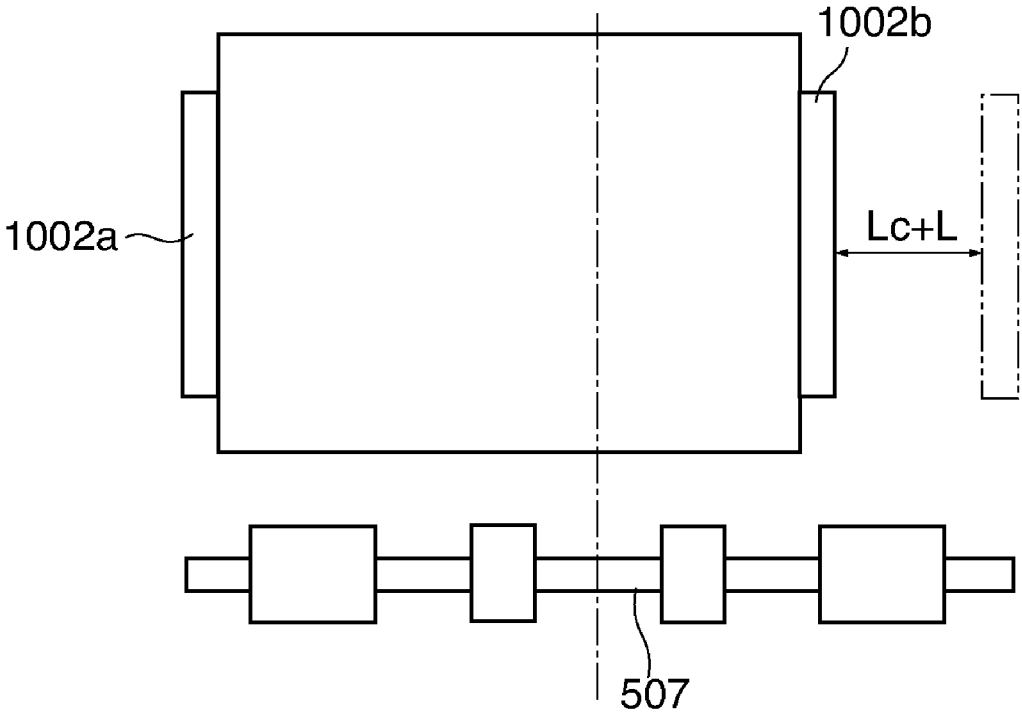

FIGS. 8A and 8B are views useful in explaining respective standby positions (reference positions) of the first alignment plate 1002*a* and the second alignment plate 1002*b* of the processing tray 630.

In an example shown in FIGS. 8A and 8B, when the shift sorting mode is selected, sheets P conveyed onto the processing tray 630 are aligned to a position shifted from an offset center by a bundle offset amount Lc, and then are discharged onto the stack tray 700. Before doing this, the second alignment plate 1002*b* is on standby in a position spaced away from the right end of a sheet in proper position, as viewed in FIG. 8A, by a distance L (see FIG. 8A).

Then, when the sheets P are discharged onto the processing tray 630, the second alignment plate 1002*b* is moved in an offset direction by a distance Lc+L to thereby align the sheets P and offset the same from the offset center by the bundle offset amount Lc (see FIG. 8B). Although in the example shown in FIG. 8B, the bundle of the sheets P is offset toward the front side of the finisher 500 (toward the viewer's side in FIG. 2, i.e. leftward with respect to the sheet conveying direction), the shifting direction is switched on a sheet bundle-by-sheet bundle basis between the frontward direction (toward the front side of the finisher 500) and the rearward direction (toward the rear side of the same) whereby sheet bundles can be stacked in a sorted manner.

By the way, the size of the finisher 500 is required to be as compact as possible. However, as the allowance of the lateral registration shift amount of a sheet conveyed into the finisher 500 is set to a larger value, the length of the lateral registration-detecting device 1001 in the front-rear direction of the image forming apparatus is required to be made larger, which causes an increase in the size of the finisher 500.

Further, as the allowance of the lateral registration shift amount is set to a larger value, it is more required to set the standby positions of the alignment plates of the processing tray in consideration of the increased allowance of the lateral registration shift amount so as to prevent collision between sheets and the alignment plates. This increases the distance over which each alignment plate is required to move for sheet alignment, and hence time taken to align one sheet becomes longer. Therefore, the allowance of the lateral registration shift amount is determined in view of an apparatus size and copying productivity.

Figure 9:
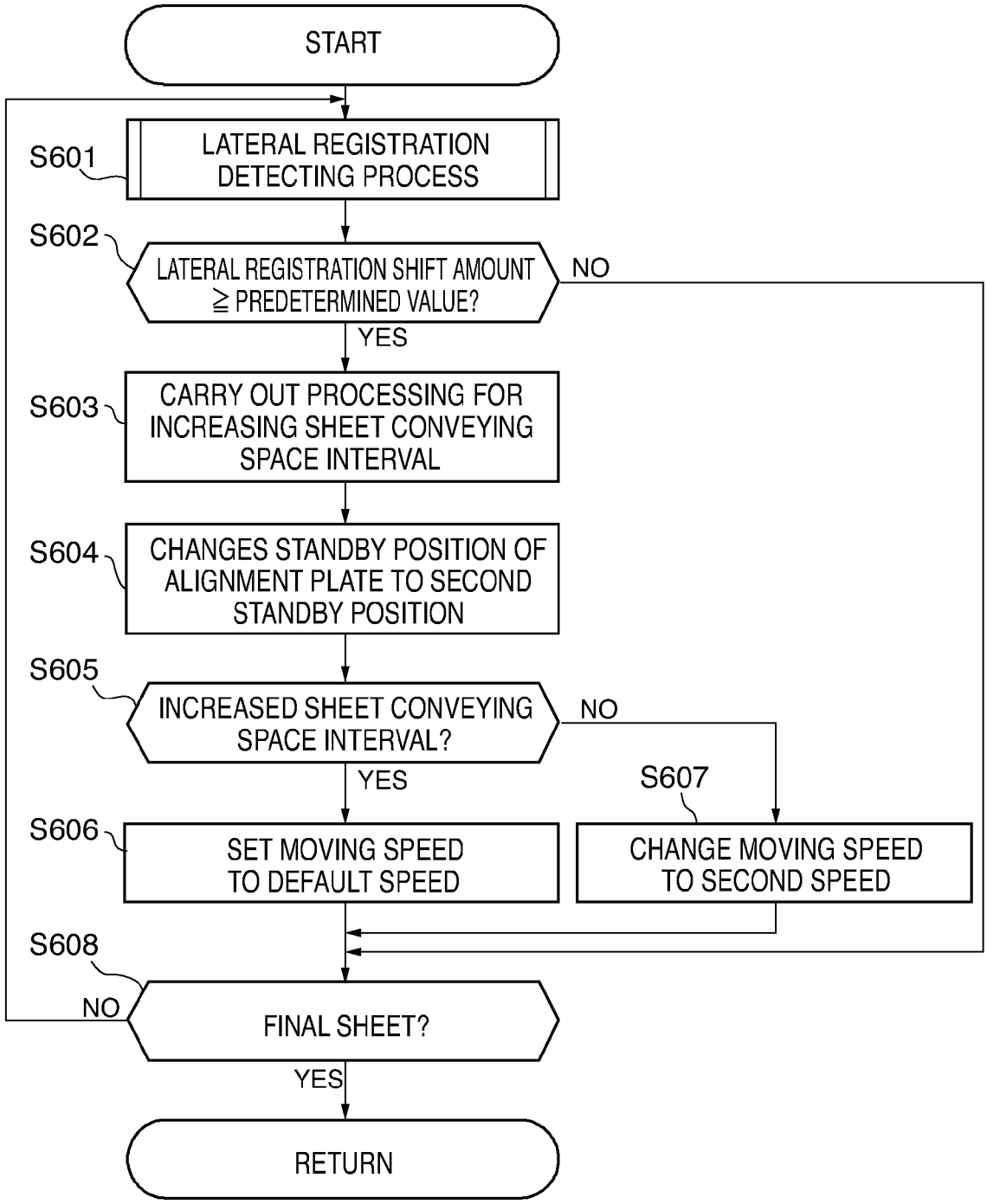
FIG. 9 is a flowchart of a lateral registration abnormality-handling process.

Next, a lateral registration abnormality-handling process executed when the lateral registration shift amount of a sheet is outside a normal range in the lateral registration detecting process described with reference to FIG. 6 will be described with reference to FIG. 9. The process in FIG. 9 is executed by the finisher control section 501.

First, in a step S601, the CPU 550 executes the lateral registration detecting process described with reference to FIG. 6. Then, in a step S602, the CPU 550 determines whether or not the absolute value of the lateral registration shift amount is not smaller than a predetermined value. In the present embodiment, the predetermined value is set to 12.5 mm, and the lateral registration shift amount is divided into three ranges. More specifically, assuming that the lateral registration shift amount is measured with respect to the center of the conveying path, it is determined that when the absolute value of the lateral registration shift amount is smaller than ±12.5 mm, it is in a normal range, when not smaller than ±12.5 mm and smaller than ±15 mm, it is in an alarm range, and when not smaller than ±15 mm, it is in an abnormal range. It should be noted that "+" indicates a rightward shift (rearward in the finisher 500) with respect to the sheet conveying direction, i.e. a shift in the direction indicated by the arrow 43 in FIG. 5, while "−" indicates a leftward shift (frontward in the finisher 500) with respect to the sheet conveying direction, i.e. a shift in the direction indicated by the arrow 44 in FIG. 5. When the lateral registration shift amount is not smaller than ±15 mm, interference can occur between a sheet and some of apparatus components at lateral sides of the sheet conveying path in the sheet conveying direction, to cause paper jam in the worst case.

If it is determined in the step S602 that the absolute value of the lateral registration shift amount is smaller than ±12.5 mm, the process proceeds to a step S608, whereas if the absolute value of the lateral registration shift amount is not smaller than ±12.5 mm, the process proceeds to a step S603.

In the step S603, the CPU 550 instructs the CPU circuit section 150 of the copying machine 10 to switch the sheet feeding mode to a mode for increasing a sheet conveying space interval (i.e. a space interval between the trailing end of a preceding sheet and the leading end of a succeeding sheet). Then, the process proceeds to a step S604, wherein the CPU 550 changes the standby position of one of the alignment plates 1002*a* and 1002*b* for aligning the sheets conveyed onto the processing tray 630 to a second standby position according to the lateral registration shift direction and the lateral registration shift amount detected in the step S601. The second standby position is set such that the distance between the alignment plates 1002*a* and 1002*b* is made longer by a predetermined distance than when one of the alignment plates 1002*a* and 1002*b* is in the normal standby position.

Figure 11A:
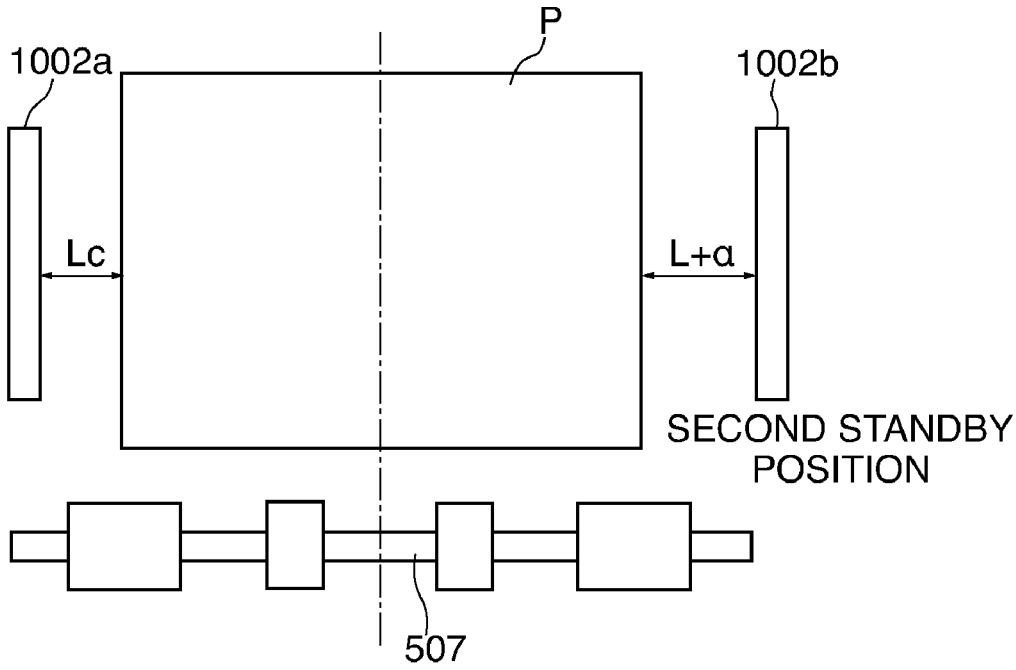
FIGS. 11A and 11B are views useful in explaining a second standby position of the alignment plate of the processing tray provided in the finisher.

FIG. 11A shows a case where the standby position of the alignment plate 1002*b* is changed from the original position spaced from the right end of a sheet in proper position by the distance L to the second standby position spaced from the original position by a distance α. This makes it possible to prevent collision between each sheet and the alignment plate 1002*a* or 1002*b* in the processing tray 630 even when the absolute value of the lateral registration shift amount of a sheet conveyed into the finisher 500 is not smaller than ±12.5 mm defining the normal range.

Next, in a step S605, the CPU 550 determines whether or not the sheet is being conveyed onto the processing tray 630 with an increased sheet conveying space interval. If the sheet is being conveyed onto the processing tray 630 with the increased sheet conveying space interval, the CPU 550 sets the moving speed of the alignment plate 1002*b* for sheet alignment to a default speed (step S606). Whenever a sheet is delivered from the copying machine 10 to the finisher 500, attribute data associated with the sheet is sent from the copying machine 10 by communication between the copying machine 10 and the finisher 500. Therefore, the finisher 500 can determine through analysis of the attribute data whether or not the sheet is being conveyed with the increased sheet conveying space interval.

On the other hand, if it is determined in the step S605 that the sheet is being conveyed onto the processing tray 630 without increasing the sheet conveying space interval, the process proceeds to a step S607, wherein the CPU 550 changes the moving speed of the alignment plate 1002*b* to a second speed higher than the default speed.

Figure 11B:
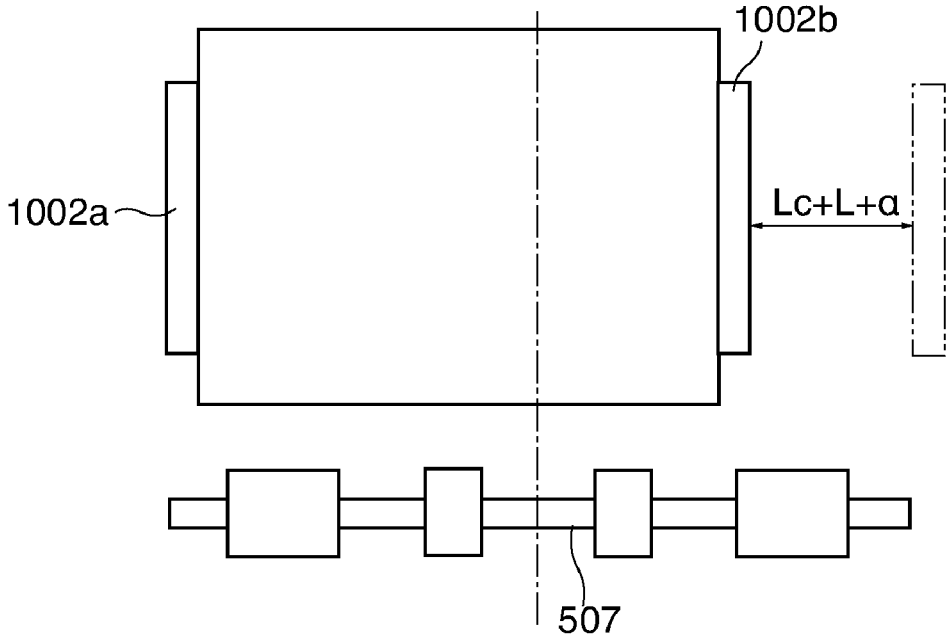

When it is determined that the absolute value of the lateral registration shift amount is not smaller than the predetermined value, a predetermined number of sheets have already been fed from the copying machine 10. Therefore, when each of these sheets is conveyed onto the processing tray 630, the standby position of the alignment plate 1002*b* has been set to the second standby position located outward of the normal standby position as shown in FIGS. 11A and 11B in the case of the illustrated example. The second standby position is the distance α farther away from the offset center than the normal standby position is, so that the moving speed of the alignment plate 1002*b* is increased by a time corresponding to the distance α so as to maintain the sheet alignment time equal to that before the standby position of the alignment plate 1002*b* was changed.

If the moving speed of the alignment plate 1002*b* is increased, alignability of sheets can be degraded. However, in the present process, the step S605 is executed as temporary processing for prevention of occurrence of paper jam which is regarded as top priority.

Next, in the step S608, the CPU 550 determines whether or not the sheet detected as being conveyed is a final one. If the sheet is not a final one, the process returns to the step S601, whereas if the sheet is a final one, the present process is terminated.

This process makes it possible to prevent paper jam from occurring in the finisher 500 even when the lateral registration shift amount of a sheet conveyed into the finisher 500 is larger than the predetermined value by the distance α or more. It should be noted that although in the description of the alignment processing given with reference to FIGS. 11A and 11B, sheets are assumed to be shifted by a plus (+) amount, i.e. in the direction indicated by the arrow 43 in FIG. 5 (rightward with respect to the conveying direction (rearward in the finisher 500)), and hence the alignment plate 1002*b* is moved to the second standby position outward of the original standby position, if sheets are assumed to be shifted by a minus (−) amount, i.e. in the direction indicated by the arrow 44 in FIG. 5 (leftward with respect to the conveying direction (frontward in the finisher 500)), the alignment processing is performed by moving the alignment plate 1002*a* to the second standby position outward of the original standby position, instead of the alignment plate 1002*b*, while holding the alignment plate 1002*b* in the original standby position.

Figure 12:
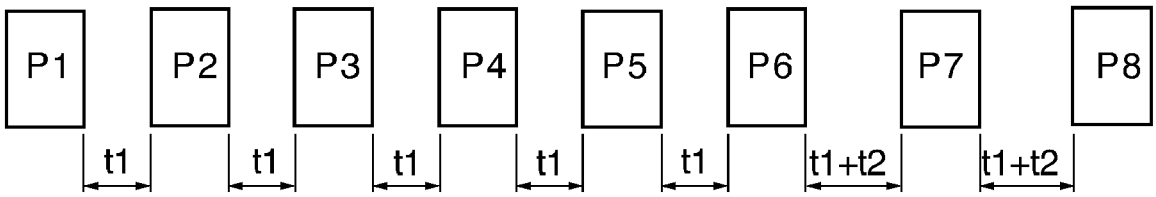
FIG. 12 is an explanatory view useful in explaining sheet conveying space intervals.

FIG. 12 is a conceptual view useful in explaining time intervals at which sheets are discharged from the copying machine 10 in the process in FIG. 9. In FIG. 12, reference numerals P1 to P8 designate sheets, respectively, and t1 and t1+t2 sheet-to-sheet designate time intervals. A sheet-to-sheet time interval represents a time period between a time point when the trailing end of a preceding sheet passes through the discharge roller pair 118 and a time point when the leading end of a sheet subsequent to the preceding sheet reaches the discharge roller pair 118. In other words, a sheet-to-sheet time interval represents a time period which a sheet takes to travel a distance between the trailing end of the preceding sheet and the leading end of the subsequent sheet. If it is determined in the step S602 in FIG. 9 that the lateral registration shift amount is within the normal range, the copying machine 10 feeds sheets at sheet-to-sheet time intervals of t1. If the lateral registration shift amount exceeds the normal range, the copying machine 10 switches the sheet feeding mode to the mode for increasing the sheet conveying space interval such that the sheet-to-sheet time interval becomes equal to t1+t2. The sheet-to-sheet time interval is set based on a value obtained by dividing the distance α by the amount of variation of the moving speed (second speed−default speed) of the alignment plate 1002*b*, so as to prevent collision between the alignment plate 1002*b* and a sheet being conveyed, even when the standby position of the alignment plate 1002*b* is located the distance α outward of the normal standby position.

It should be noted that in the present embodiment, once it has been detected in the lateral registration detecting process that the lateral registration shift amount is in the alarm range and the sheet feeding mode has been switched to the mode for increasing the sheet conveying space interval, the setting is maintained for jobs input after the mode has been switched (i.e. in the next and following jobs). When a service person cancels the sheet conveying space interval-increasing mode by operating the operating and display unit 400, the increased sheet conveying space interval is switched to the normal sheet conveying space interval.

Figure 13:
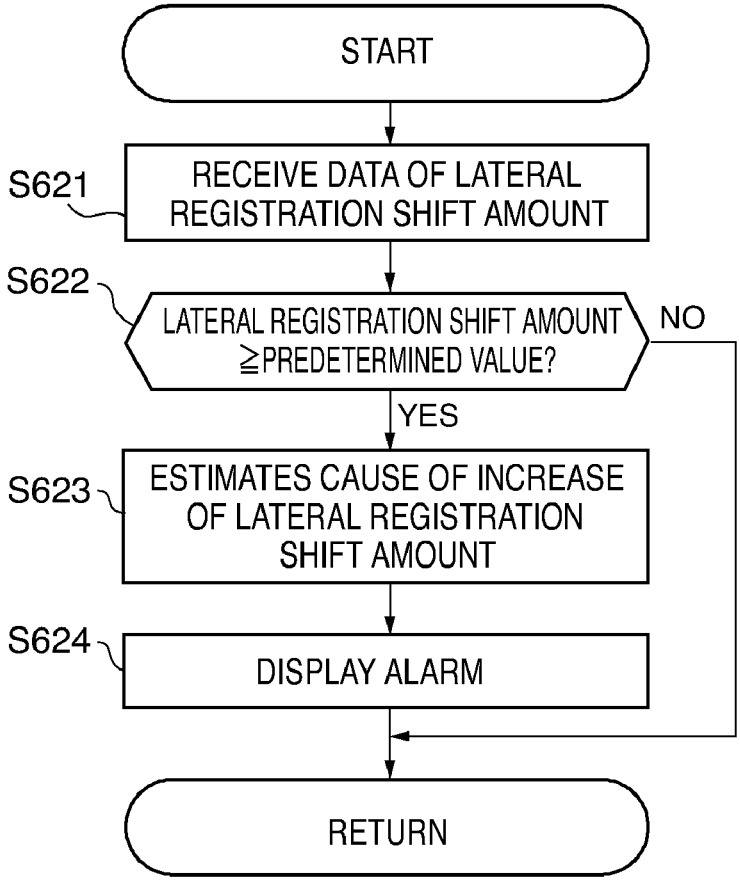
FIG. 13 is a flowchart of an alarm display process executed when lateral registration abnormality is detected.

Next, with reference to FIG. 13, a description will be given of an alarm display process executed when it is detected, in the lateral registration detecting process described with reference to FIG. 6, that the lateral registration shift amount of a sheet has exceeded the normal range. This control process is executed by the CPU 150A of the CPU circuit section 150 of the copying machine 10.

First, in a step S621, the CPU 150A receives data of the lateral registration shift amount detected in the lateral registration detecting process described with reference to FIG. 6, from the CPU 550 of the finisher control section 501. Then, in a step S622, the CPU 150A determines whether or not the received lateral registration shift amount is not smaller than a predetermined value. It should be noted that when the number of times that the registration shift amount exceeds the predetermined value has reached a predetermined count, the CPU 550 may notify the CPU 150A of the fact.

If it is determined in the step S622 that the absolute value of the lateral registration shift amount is smaller than ±12.5 mm, the process is terminated. If the absolute value of the lateral registration shift amount is not smaller than ±12.5 mm, the process proceeds to a step S623, wherein the CPU 150A estimates the cause of an increase in the lateral registration shift amount.

The cause of the increase in the lateral registration shift amount can be estimated as follows: For example, when the count of a sheet feed counter, not shown, for counting the number of sheets fed by the copying machine 10 has reached a value indicative of maintenance timing for rollers that convey sheets, it can be determined that roller cleaning/replacement timing has come. Further, when lateral registration shift occurs only in sheet feed operation by a specific sheet feed cassette in the copying machine 10, it can be supposed that lateral registration by the sheet feed cassette has been shifted.

Next, the process proceeds to a step S624, wherein the CPU 150A instructs the operating and display unit control section 401 to display an alarm on the operating and display unit 400. In the present embodiment, a message (countermeasure) recommending cleaning/replacement of sheet conveying rollers is displayed.

It should be noted that the above-described control process may be executed by the CPU 550 of the finisher 500. In this case, the CPU 550 instructs the CPU 150A to cause the alarm to be displayed on the operating and display unit 400.

As described above, according to the present embodiment, when the lateral registration position of a sheet conveyed into the finisher 500 is shifted from the proper position by not smaller than a predetermined shift amount, the standby position of one of the alignment plates 1002*a* and 1002*b* is changed to a position further spaced away from the sheet in proper position than the normal position is, according to the shift direction, and at the same time makes the sheet conveying space interval of the copying machine 10 longer than it normally is. As a consequence, even when the lateral registration position of a sheet conveyed into the finisher 500 is shifted from the proper position by the predetermined shift amount +α, it is possible to avoid collision between the alignment plate 1002*a* or 1002*b* of the processing tray 630 and the sheet. This makes it possible to prevent paper jam from occurring in the finisher 500 to thereby ensure the stability of the system.

Further, since the maintenance message is displayed on the display section of the operating and display unit 400 when the lateral registration position of a sheet conveyed into the finisher 500 is shifted by not smaller than the predetermined shift amount, it is possible to notify the user of proper maintenance to thereby enhance the operability of the system.

Next, an image forming system according to a second embodiment of the present invention will be described with reference to FIGS. 14 to 18. It should be noted that duplicate description of components corresponding to those in the first embodiment is omitted by designating them using the same reference numerals, and only different points from the first embodiment will be described.

When the sheet conveying speed of the copying machine 10 is increased, it is impossible to cope with the increased speed only by the spacing action of the alignment plate 1002*b* of the processing tray 630 in the finisher 500. To solve this problem, in the present embodiment, the lateral registration position of a sheet is corrected at a location upstream of the processing tray 630 in the finisher 500.

Figure 14:
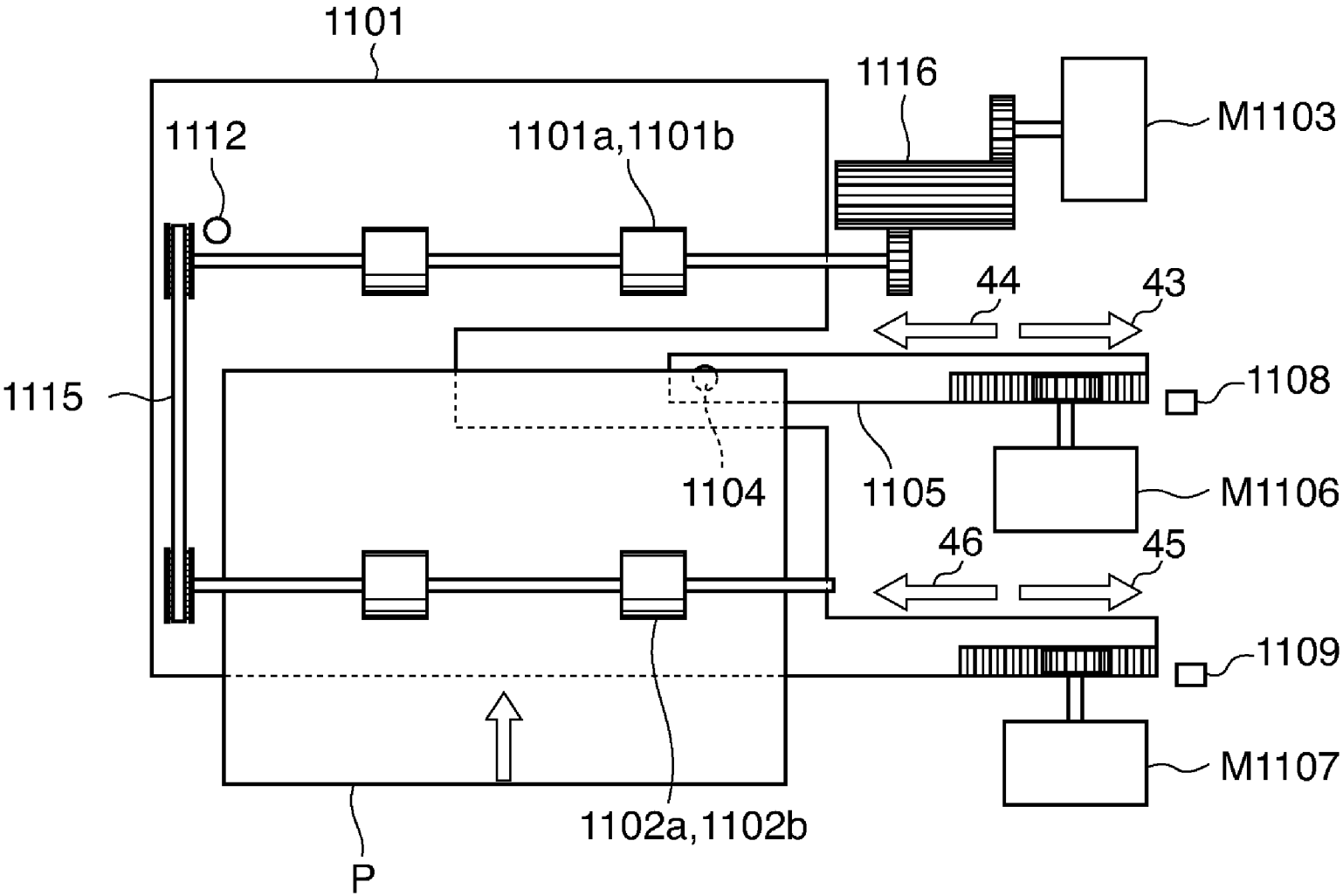
FIG. 14 is a view useful in explaining a lateral registration-correcting device provided in a finisher as a component unit of an image forming system according to a second embodiment of the present invention.

FIG. 14 is a schematic view of a lateral registration-correcting device 1101. In FIG. 14, reference numeral M1103 designates a conveying motor. The conveying motor M1103 applies a driving force to the conveying rollers 1101*a* and 1102*a* via the gear 1116 and the timing belt 1115, and cooperates with the driven rollers 1101*b* and 1102*b* to convey a sheet.

The leading end of the sheet being conveyed is detected by the lateral registration sensor 1104 as a position detector unit. The lateral registration sensor 1104 is mounted in the lateral registration sensor unit 1105 that is driven by the lateral registration sensor-shifting motor M1106 to move in the left-right directions, as viewed in FIG. 14, indicated by the arrows 44 and 43, respectively. The home position of the lateral registration sensor unit 1105 is detected by the lateral registration HP sensor 1108.

In FIG. 14, reference numeral M1107 designates a lateral registration unit-shifting motor that drives the lateral registration-correcting device 1101 provided separately from the lateral registration sensor unit 1105, to move the device 1101 in the left-right directions, as viewed in FIG. 14, indicated by the arrows 46 and 45, respectively. The home position of the lateral registration-correcting device 1101 is detected by a lateral registration unit HP sensor 1109. Further, in FIG. 14, reference numeral 1112 designates a trailing end-detecting sensor, and the trailing end-detecting sensor 1112 not only detects a sheet being conveyed, but also detects that the trailing end of the sheet has passed through the conveying rollers 1101*a* and 1101*b* within the lateral registration-correcting device 1101. It should be noted that a lateral registration detecting process in the present embodiment is the same as that described with reference to FIG. 6, and therefore description thereof is omitted.

Figure 15:
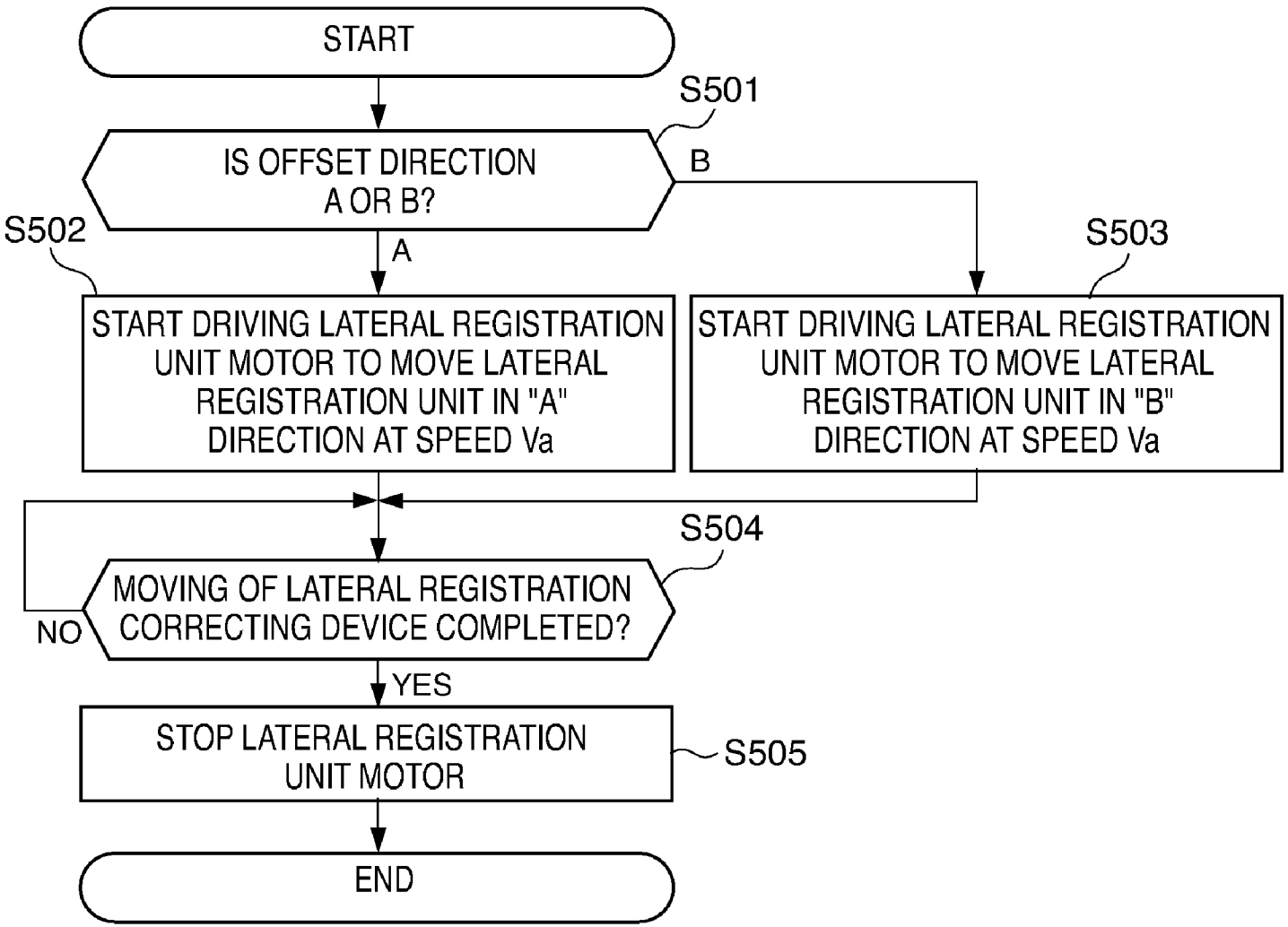
FIG. 15 is a flowchart of a lateral registration correcting process.

Next, a lateral registration correcting process will be described with reference to FIG. 15. It should be noted that in the illustrated example, the finisher 500 is operating in the shift sorting mode, and hence, the lateral registration correction performed by the lateral registration-correcting device 1101 includes shifting of sheets by a predetermined bundle offset amount Lb, which is executed on a sheet-bundle-by-sheet bundle basis, alternately in the A direction and in the B direction.

First, in a step S501, the CPU 550 determines whether the direction of shifting the bundle (offset direction) is the A direction or the B direction. If it is determined in the step S501 that the present sheet is to be shifted in the A direction, the CPU 550 starts driving the lateral registration unit-shifting motor M1107 to move the lateral registration-correcting device 1101 in the A direction at a speed Va (step S502). It should be noted that the A direction is indicated by the arrow 46 in FIG. 14.

On the other hand, if it is determined in the step S501 that the present sheet is to be shifted in the B direction, the CPU 550 starts driving the lateral registration unit-shifting motor M1107 to move the lateral registration-correcting device 1101 in the B direction at the speed Va (step S503). It should be noted that the B direction is indicated by the arrow 45 in FIG. 14.

Next, the CPU 550 determines, based on a driving amount of the lateral registration unit-shifting motor M1107, whether or not the lateral registration-correcting device 1101 has moved over a distance corresponding to a lateral registration shift amount Lb+ a bundle offset amount La (step S504). The distance corresponding to the lateral registration shift amount Lb+ the bundle offset amount La is calculated as the absolute value of the sum of the lateral registration shift amount stored in the RAM 403 in the step S410 of the FIG. 6 lateral registration-detecting process with a sign (plus (+) for the A direction or minus sign (−) for the B direction) and the bundle offset amount Lb with a sign (plus (+) for the A direction or minus sign (−) for the B direction) given according to the offset direction determined in the step S501 of the present process. The CPU 550 repeatedly carries out the step S504 until the lateral registration-correcting device 1101 has moved over the distance corresponding to the lateral registration shift amount Lb+ the bundle offset amount La. If it is determined in the step S504 that the lateral registration-correcting device 1101 has moved over the distance, the CPU 550 stops the lateral registration unit-shifting motor M1107 (step S505), followed by terminating the lateral registration correcting process.

The bundle offset amount La represents a bundle-by-bundle offset amount in the shift sorting mode, and it is set to 15 mm in the present embodiment. The normal value of the lateral registration shift amount of a sheet is configured to fall within a range of ±12.5 mm, and therefore a maximum lateral registration correction amount is 15 mm+12.5 mm=27.5 mm.

In the present embodiment, the lateral registration-correcting device 1101 performs the lateral registration correcting operation as above, whereafter the sheet is conveyed onto the processing tray 630 of the finisher 500 to be subjected to the alignment processing on the processing tray 630.

Next, a description will be given of an aligning operation performed in the shift sorting mode when lateral registration correction is executed by the finisher 500, with reference to FIGS. 16A, 16B, and 17.

Figure 16A:
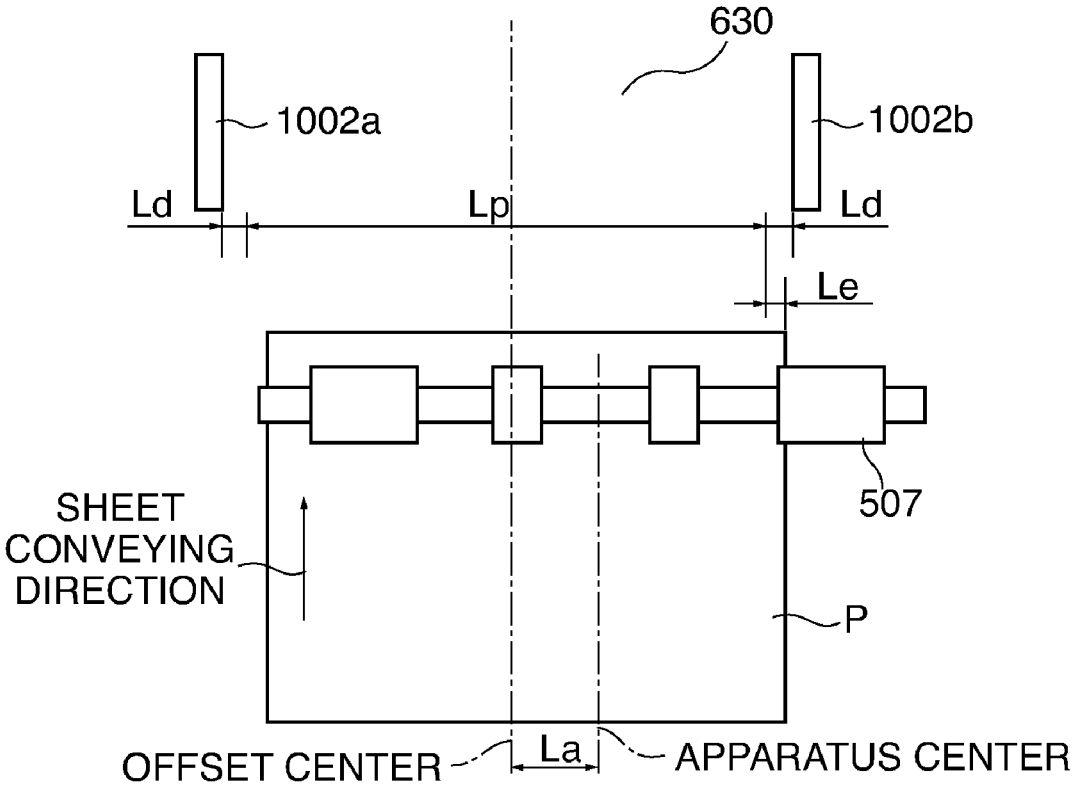
FIGS. 16A and 16B are views useful in explaining an alignment operation carried out by the alignment plates when the lateral registration correction is performed by the lateral registration-correcting device.

FIG. 16A is a view showing the standby positions of the respective alignment plates 1002*a* and 1002*b* in a case where a sheet bundle is offset for alignment toward the rear side of the finisher 500 (rightward with respect to the sheet conveying direction). In the case of the illustrated example, it is assumed that the lateral registration-correcting device 1101 has already performed not only correction of the lateral registration shift amount Lb of each sheet P conveyed onto the processing tray 630, which is generated when it is discharged from the copying machine 10, but also shifting of the lateral registration thereof by the bundle offset amount La, as described above. Therefore, the sheet P is offset by the lateral registration-correcting device 1101, followed by being stacked on a rear-side stacking position (first stacking position) shown in FIG. 16A.

Therefore, it suffices to set an alignment distance Ld over which each of the alignment plates 1002*a* and 1002*b* should be moved on the processing tray 630 for alignment of the sheets to a distance corresponding to a shift amount slightly larger than a shift amount Le generated during sheet conveyance from the lateral registration-correcting device 1101 to the processing tray 630 (Ld>Le). It should be noted that the alignment distance Ld is a distance over which each of the alignment plates 1002*a* and 1002*b* is to be moved from the standby position to the alignment position. Thus, it is possible to prevent each sheet P conveyed onto the processing tray 630 from colliding with the alignment plate 1002*a* or 1002*b* to cause a defective conveyance.

Figure 16B:
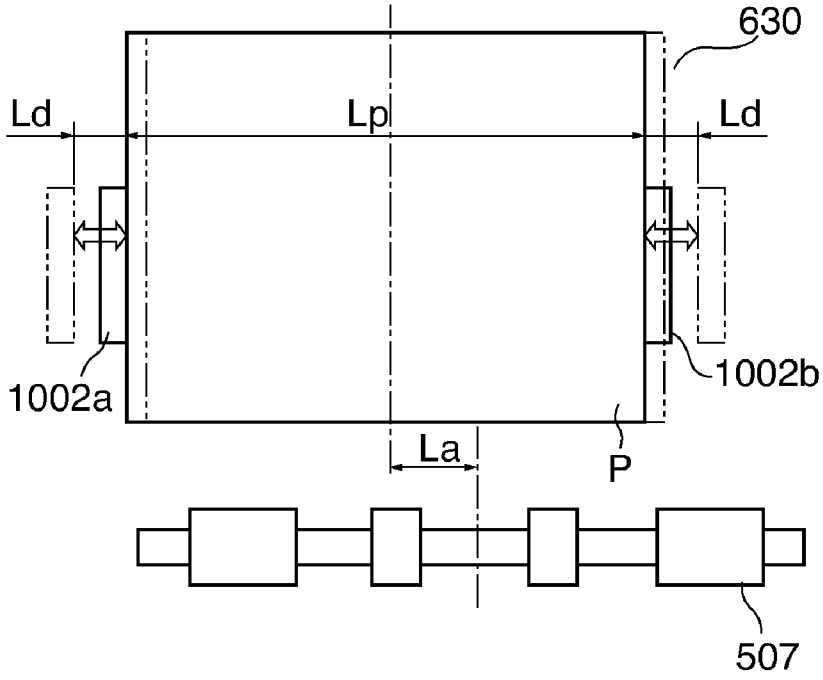

After the sheet P has been conveyed onto the processing tray 630, each of the first alignment plate 1002*a* and the second alignment plate 1002*b* is moved toward the alignment position by the alignment distance Ld as shown in FIG. 16B, whereby alignment of the sheet P on the center position is performed. More specifically, in the case of the illustrated example, the first alignment plate 1002*a* and the second alignment plate 1002*b* are moved from the respective standby positions corresponding to the rear-side stacking position offset toward the rear side of the finisher 500 to align a sheet bundle stacked on the processing tray 630. Then, the aligned sheet bundle is discharged onto the stack tray 700 by the discharge roller pairs 580*a* and 580*b*.

An aligning operation carried out for alignment of a sheet bundle to be offset toward the rear side of the finisher 500 is similar to the operation described above. More specifically, as shown in FIG. 17, similar alignment can be performed simply by switching the position of the center of offset sheets as a reference position between a front-side position and a rear-side position. In the case of the illustrated example, each sheet P is offset by the lateral registration-correcting device 1101, and then is stacked on a front-side stacking position (second stacking position) offset toward the front side of the finisher 500, as shown in FIG. 17.

Figure 17:
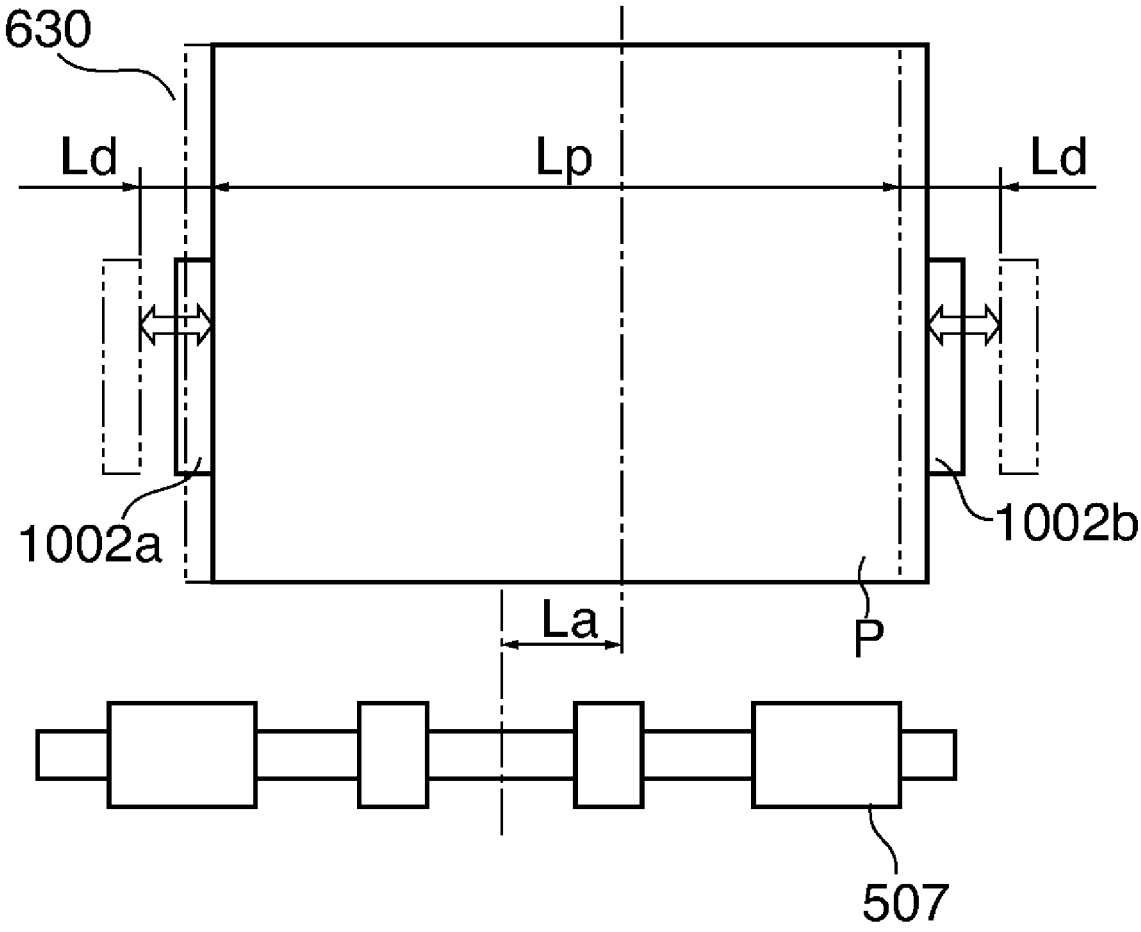
FIG. 17 is a view useful in explaining the alignment operation carried out by the alignment plates when the lateral registration correction is performed by the lateral registration-correcting device.

As is distinct from the rear-side stacking position shown in FIG. 16B, the front-side stacking position shown in FIG. 17 is offset toward the front side of the finisher 500 from the offset center by the predetermined offset amount. When a sheet bundle is to be stacked on the rear-side stacking position, the alignment plates 1002*a* and 1002*b* are in the respective standby positions, shown in FIG. 17, corresponding to the rear-side stacking position. The alignment plates 1002*a* and 1002*b* are moved from the respective standby positions corresponding to the rear-side stacking position to align a sheet bundle stacked on the processing tray 630. The alignment distance in this case is the same as that in the case shown in FIG. 16B where the sheet bundle is offset frontward, and hence description thereof is omitted. Then, the aligned sheet bundle is discharged onto the stack tray 700 by the discharge roller pairs 580*a* and 580*b*.

For example, when the shift sorting mode is selected, an operation for aligning a sheet bundle on the rear-side stacking position shown in FIG. 16B and discharging the same onto the stack tray 700, and then aligning a following sheet bundle on the front-side stacking position shown in FIG. 17 and discharging the same onto the stack tray 700 is repeatedly carried out. As a consequence, sheet bundles are stacked on the stack tray 700 in a state offset on a sheet bundle basis.

To be specific based on the above-described embodiment, when sheets are to be stacked on the front-side stacking position of the processing tray 630, the alignment plates

1002*a* and 1002*b* are moved to the respective standby positions corresponding to the front-side stacking position in advance, whereas when sheets are to be stacked on the rear-side stacking position of the processing tray 630, the alignment plates 1002*a* and 1002*b* are moved to the respective standby positions corresponding to the rear-side stacking position in advance. Further, by making the distance between the alignment plates 1002*a* and 1002*b* shorter than that in a case where sheets are not shifted, it is possible to shorten time required for an aligning operation to thereby increasing the number of aligned sheets per unit time period.

An alarm display process executed when it is detected, in the lateral registration detecting process that the lateral registration shift amount of a sheet has exceeded the normal range is basically the same as that of the first embodiment described with reference to FIG. 13, and hence description thereof is omitted.

It should be noted that the present invention is not limited to the above-described embodiments, but it can be practiced in various forms, without departing from the spirit and scope thereof.

For example, although in the above-described embodiments, the finisher is employed as a sheet processing apparatus, the present invention can be applied to any apparatus, such as a stacker, a casing-in bookbinding apparatus, or a saddle stitching bookbinding apparatus, which has a sheet aligning unit provided therein.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims priority from Japanese Patent Application No. 2007-082360 filed Mar. 27, 2007, which is hereby incorporated by reference herein in its entirety.

What is claimed is:

1. A sheet processing apparatus including a sheet stack unit configured to stack sheets from an image forming apparatus, comprising:

an alignment unit, provided in a manner movable in a lateral direction which is orthogonal to a sheet conveying direction in the sheet processing apparatus, configured to align the sheets in the lateral direction by being brought into abutment with opposite side edges of the sheet stacked on the sheet stack unit;

a position detecting unit configured to detect a sheet position of the lateral direction of the sheet being conveyed by the sheet processing apparatus; and a control unit configured to, when the sheet position detected by said position detecting unit is beyond a predetermined position, change a standby position of said alignment unit such that spacing of said alignment unit in the lateral direction is widened by a predetermined amount, and extend a conveying interval of sheets in the image forming apparatus by a predetermined time period.

2. A sheet processing apparatus as claimed in claim 1, comprising a shift unit, provided upstream of said alignment unit in the sheet conveying direction, configured to shift the sheet in the lateral direction of the sheet according to the sheet position detected by said position detecting unit.

3. A sheet processing apparatus as claimed in claim 1, wherein said control unit causes said alignment unit to maintain a standby position in subsequent print jobs following a present job, when the lateral position of the sheet detected by said position detecting unit is beyond the predetermined position, and cause the conveying interval of sheets in the image forming apparatus to be maintained.

4. A sheet processing apparatus as claimed in claim 1, wherein said control unit increases a moving speed of said alignment unit for aligning the sheets, when the sheet position detected by said position detecting unit is beyond the predetermined position.

5. A sheet processing apparatus including a sheet stack unit configured to stack sheets from an image forming apparatus, comprising:

an alignment unit, provided in a manner movable in a lateral direction which is orthogonal to a sheet conveying direction in the sheet processing apparatus, configured to align the sheets in the lateral direction by being brought into abutment with opposite side edges of the sheet stacked on the sheet stack unit;

a position detecting unit configured to detect a sheet position of the lateral direction of the sheet being conveyed in the sheet processing apparatus;

a shift conveying unit, provided upstream of said alignment unit in the sheet conveying direction, configured to shift the sheet in the lateral direction; and a control unit configured to, when the sheet position detected by said position detecting unit is beyond a predetermined position, change a standby position of said alignment unit such that spacing of said alignment unit in the lateral direction is widened by a predetermined amount, and increase a moving speed of said alignment unit during an operation for aligning the sheets.

6. An image forming system comprising an image forming apparatus that performs image formation on sheets, and a sheet processing apparatus connected to the image forming apparatus, the sheet processing apparatus including a sheet stack unit configured to stack sheets from an image forming apparatus, comprising:

an alignment unit, provided in a manner movable in a lateral which is orthogonal to a sheet conveying direction in the sheet processing apparatus, configured to align the sheets in the lateral direction by being brought into abutment with opposite side edges of the lateral direction of the sheet stacked on the sheet stack unit;

a position detecting unit configured to detect a sheet position of the lateral direction of the sheet being conveyed in the sheet processing apparatus; and a control unit configured to, when the sheet position detected by said position detecting unit is beyond a predetermined position, change a standby position of said alignment unit such that spacing of said alignment unit in the lateral direction is widened by a predetermined amount, and extend a conveying interval of sheets in the image forming apparatus by a predetermined time period.

7. An image forming system comprising an image forming apparatus that performs image formation on sheets, and a sheet processing apparatus connected to the image forming apparatus, the sheet processing apparatus including a sheet stack unit configured to stack sheets from an image forming apparatus, comprising:

an alignment unit, provided in a manner movable in a lateral direction which is orthogonal to a sheet conveying direction in the sheet processing apparatus, configured to align the sheets in the lateral direction by being brought into abutment with opposite side edges of the sheet stacked on the sheet stack unit;

a position detecting unit configured to detect a sheet position of the lateral direction of the sheet being conveyed in the sheet processing apparatus;

a shift conveying unit provided upstream of said alignment unit in the sheet conveying direction, for shifting the sheet in the lateral direction; and a control unit configured to, when the sheet position detected by said position detecting unit is beyond a predetermined position, change a standby position of said alignment unit such that spacing of said alignment unit in the lateral direction is widened by a predetermined amount, and increase a moving speed of said alignment unit during an operation for aligning the sheets.

* * * * *